United States Patent [19]

Tachibana

[11] 4,107,801

[45] Aug. 22, 1978

[54] LOOP LENGTH CORRECTION OF SPIRALLY SET TEXTILE FABRIC IN PROCESSING APPARATUS

[75] Inventor: Yoshishige Tachibana, Akashi, Japan

[73] Assignee: Toyo Boseki Kabushiki Kaisha, Osaka, Japan

[21] Appl. No.: 768,643

[22] Filed: Feb. 14, 1977

[30] Foreign Application Priority Data

Dec. 17, 1976 [JP] Japan ..... 51-152736

[51] Int. Cl.[2] ..... D06B 3/10; D06B 17/00; D06B 23/00

[52] U.S. Cl. ..... 8/152; 68/13 R; 68/22 R; 68/176; 226/43

[58] Field of Search ..... 68/13 R, 22 R, 176; 118/6, 419; 8/151, 152; 34/152; 200/61.13, 61.14; 26/21; 226/43, 50, 176

[56] References Cited

U.S. PATENT DOCUMENTS

| | | | |
|---|---|---|---|
| 2,998,175 | 8/1961 | Topping | 226/43 |
| 3,148,816 | 9/1964 | Martin et al. | 226/50 X |
| 3,848,438 | 11/1974 | Tachibana et al. | 68/22 R |
| 3,875,769 | 4/1975 | Inoue | 68/22 R |
| 3,931,722 | 1/1976 | Isoda | 68/176 |
| 3,977,220 | 8/1976 | Clark et al. | 68/22 R |

*Primary Examiner*—Philip R. Coe
*Attorney, Agent, or Firm*—Staas & Halsey

[57] ABSTRACT

A method of correcting individual loop lengths of a spirally looped textile fabric in a processing apparatus comprises the steps of: connecting a leader cloth having detectable portions spaced apart by a predetermined distance commensurate with an ideal loop length to the introduction end of the textile fabric remaining in the processing chamber; feeding the textile fabric in the forward direction while the textile fabric is subjected to the processing operation; stopping the travel of only the leading end of the leader cloth upon detection of the leading detectable portion at the leading position of the first loop length portion; feeding the remaining textile fabric, with the leading end of the leader cloth stopped, until the trailing detectable portion is detected at the trailing position of the first loop length portion; releasing the stoppage of the leading end of the leader cloth to correct the loop length of the first loop length portion; and repeating the above described correcting steps for the other loop length portions. Alternatively, the said ideal loop length is determined by counting the number of rotations of the squeeze roll assembly after detection of the leading detectable portion at the trailing position of the loop length portion.

28 Claims, 20 Drawing Figures

LOOP LENGTH CORRECTION OF SPIRALLY SET TEXTILE FABRIC IN PROCESSING APPARATUS

BACKGROUND OF THE INVENTION

1. Field of the Invention

The present invention relates generally to a method for continuously processing a continuous textile fabric. More specifically, the present invention relates to an improved continuous processing method adapted to process a continuously connected textile fabric while moving it alternately forwardly and backwardly in such a manner that the forward traveling amount is greater than the backward traveling amount.

2. Description of the Prior Art

A continuous processing apparatus has already been put into practical use which is adapted to process a successively connected continuous textile fabric while moving the same alternately forwardly and backwardly in such a manner that the forward traveling amount is greater than the backward traveling amount. In this context, the words "successively connected continuous textile fabric" include woven fabrics, knitted fabrics and the like. In such a continuous processing apparatus, a successively connected continuous textile fabric is fed in a rope-like form and subjected to washing, scouring, bleaching, milling or similar treatment in the processing section in the path of travel of the fabric.

A continuous processing apparatus of interest is disclosed in U.S. Pat. No. 3,848,438, issued Nov. 19, 1974 to Yoshishige Tachibana et al, and assigned to the same assignee as the present invention. The referenced patent takes advantage of the fact that a seam is normally provided, at predetermined intervals, on the continuously connected textile fabric, and thus the seam presents a thickened portion as compared with the other portions of the fabric. Upon passing of the textile fabric between the squeezing rolls and through the processing chamber, the detectable portions such as the thickened seams are detected to control the feeding operation of each portion. The slacking amount of the textile fabric in the processing chamber is controlled by, at least, controlling the reciprocal feeding operation of the detectable portion in a given relation. To that end, the apparatus of the referenced patent includes a plurality of squeezing rolls and a textile feeding path comprising a plurality of processing liquid tanks arrayed in turn, and seam detecting limit switches are provided at the places of the squeezing rolls, with the distance of the path between adjacent limit switches being chosen to be almost the same as the interval of said seams. In a state where the seams are positioned at the squeezing rolls, and thus at the limit switches, all the squeezing rolls are driven in a forward direction at once and after a predetermined relatively large forward traveling amount, they are driven in a backward direction by a predetermined relatively small backward traveling amount, the difference between the forward and backward traveling amounts being chosen to be approximately equivalent to a distance of the interval of said seams divided by an integer. During the final backward driving operation in one full cycle of the forward and backward reciprocating operations for the number of times of said integer, said limit switches are enabled and according to the order of arrival the seams drive the limit switches to bring the squeezing rolls to a stop. When all the squeezing rolls are brought to a stop, the limit switches are disabled to repeat again said operation cycle. The referenced patent apparatus is disadvantageous in that in order to achieve improved processing results a number of tanks are required; this is not economical and also requires a large space for installation.

Another continuous processing apparatus of interest is disclosed in the copending United States patent application, Ser. No. 674,070, filed by the same inventor as that of the present invention and assigned to the same assignee as the present invention. The processing apparatus disclosed in the referenced application comprises a processing chamber containing a processing liquid, a squeeze roll assembly disposed above the processing chamber and guide rolls disposed on opposite sides of the squeeze roll assembly, the textile fabric in a rope-like form being introduced into the processing chamber at one end thereof and successively and spirally set toward the other end of the processing chamber so as to extend around the squeeze roll assembly and guide rolls and through the processing liquid many times and to travel as the squeeze roll assembly and guide rolls are rotated. The squeeze roll assembly and guide rolls are adapted to be reversibly rotatable and controlled so that the forward traveling amount of the rope-like textile fabric is greater than the backward traveling amount thereof. Thus, the rope-like textile fabric is subjected to impregnation with processing liquid and subsequent squeezing action many times while repeating alternate forward and backward travels, and it is gradually advanced an amount corresponding to the difference between the forward and backward traveling amounts for each reciprocating cycle.

In such a processing apparatus as disclosed in the referenced application, a slip could occur at successive nipped regions of the textile fabric set around the squeeze roll assembly. Since the amount of slip is different from nip to nip, an unevenness in the amount of travel of the textile fabric is caused at the individual nipped regions thereof during the processing which may take place for many hours, and hence an unevenness is caused in the length of successive portions of the textile fabric included between adjacent nips of the squeeze roll assembly. Extreme variations in the length of portions of the fabric included between adjacent nips, i.e. the individual loop lengths of the fabric, could cause kinking and twining around the squeeze roll assembly and breakage rakes of the textile fabric, and hence damage to and deterioration of the fabric. Thus, it is necessary to correct the individual loop length before such extreme variations in the individual loop lengths of the fabric occur.

In the past correction of the individual loop lengths was carried out by an operator through visual observation, which made accurate correction impossible. On the other hand, the processing liquid in the processing chamber becomes turbid and full of foam during the prolonged processing of the fabric, and this makes the correcting operation difficult and results in degradation of the fabric and stoppage of the apparatus for a long time period. In addition, the correcting operation requires the work of pulling a wet and weighty fabric, which is hard labor and must be done in a bad environment.

Therefore, the referenced patent application also proposes an apparatus for automatically and accurately correcting the individual loop lengths of the fabric in a continuous processing apparatus comprising a processing chamber containing a processing liquid, a squeeze roll assembly disposed above the processing chamber, and guide rolls disposed on opposite sides of the squeeze roll assembly, the textile fabric in rope-like form being introduced into the processing chamber at one end thereof and successively and spirally set toward the other end of the processing chamber so as to extend around the squeeze roll assembly and guide rolls and through the processing liquid many times and to travel as the squeeze roll assembly and guide rolls are rotated. More specifically, the method for correcting the individual loop lengths of the fabric disclosed in the referenced patent application comprises the steps of feeding a continuous textile fabric in a rope-like form set successively and spirally around a squeeze roll assembly disposed above a processing chamber so as to travel through the processing chamber, stopping the machine after a predetermined feeding time period or a predetermined number of reciprocating feeding times, severing the continuous textile fabric both at the input and output ends of the processing chamber, connecting a loop length correcting textile fabric having detectable portions spaced apart a predetermined distance therebetween commensurate with an ideal individual loop length to both ends of the textile fabric remaining in the processing chamber so as to form a large endless loop, feeding the said large endless loop through the processing chamber for correcting the individual loop lengths of the fabric upon detection of the detectable portions, removing the said loop length correcting textile fabric by severing at both ends thereof, connecting again a continuous textile fabric to be processed to the input and output ends of the textile fabric, as corrected, of the individual loop lengths remaining in the processing chamber, and again feeding the textile fabric for normal processing.

The apparatus disclosed in the referenced patent application can correct automatically and accurately the individual loop lengths of the continuous textile fabric. Nevertheless, the apparatus and method of the referenced patent application require that, in order to correct the individual loop lengths of the textile fabric in the processing chamber, the continuous textile fabric is once severed at the input and output ends of the processing chamber and, after correction of the individual loop lengths, the textile fabric is brought to the original position, the loop length correcting textile fabric is removed, and thereafter the textile fabric to be processed is connected again to the textile fabric remaining in the processing chamber. Repetitive separation and connection of the textile fabric to be processed and the loop length correcting textile fabric require repetitive manual operations, which productivity and make full automation of the process difficult to achieve.

SUMMARY OF THE INVENTION

According to the present invention, there is provided an improved method for correcting or unifying the individual loop lengths of the textile fabric in an apparatus for successively processing a continuous textile fabric, comprising squeeze roll means elongated in the axial direction thereof for squeezing said continuous textile fabric when it is passed therethrough, said continuous textile fabric being successively and spirally set around said squeeze roll means from one end to the other end of said squeeze roll means, whereby a plurality of loop like portions are formed between the respective adjacent two nipped points of said continuous textile fabric as nipped by said squeeze roll means, said continuous textile fabric comprising at least one detectable portion, means provided in association with said squeeze roll means for processing said loop like portions of said continuous textile fabric, as spirally set around said squeeze roll means, means for feeding said continuous textile fabric as spirally set around said squeeze roll means, feed control means for enabling said feeding means to feed said continuous textile fabric, a plurality of detecting means disposed in successively displaced positions, each associated with said nipped points of said continuous textile fabric as nipped by said squeeze roll means, for detecting said detectable portion of said continuous textile fabric, and means responsive to said detecting means for unifying to a predetermined reference loop length the lengths of the respective loop like portions of said continuous textile fabric between adjacent two nipped points of said continuous textile fabric as nipped by said squeeze roll means. More specifically, the inventive method comprises the steps of process feeding said continuous textile fabric for processing the same by said processing means, detecting said detectable portion of said continuous textile fabric by means of one of said detecting means, stopping upon detection of said detectable portion of said continuous textile fabric the feed of the nipped point of said continuous textile fabric associated with said one detecting means, determining a point on said continuous textile fabric spaced by said predetermined reference loop length from said nipped point of said continuous textile fabric associated with said one detecting means toward the anti-feed direction direction opposite to feeding direction, correct feeding said continuous textile fabric, with said nip point of said continuous textile fabric associated with said one detecting means stopped, releasing said stoppage of said nipped point of said continuous textile fabric associated with said one detecting means when said determined point reaches the nipped point behind and adjacent to said nipped point associated with said one detecting means, whereby the loop length of one loop like portion is corrected to said reference loop length, and repeating said steps with respect to other loop like portions.

According to one preferred embodiment of the present invention, said determining step comprises the steps of measuring the amount of travel of said continuous textile fabric during said feeding step, enabling said measuring operation upon detection of said detectable portion by means of second detecting means backward adjacent of said first mentioned detecting means, disabling the measuring operation upon detection of said detectable portion by means of said first mentioned detecting means, whereby actual loop length of the loop like portion between the nipped point associated with said first mentioned detecting means and the nipped point associated with said second detecting means, comparing said actually measured loop length of said loop like portion with said reference loop length for evaluating the difference length therebetween, and said correct feeding step comprises the step of feeding said continuous textile fabric the distance in the direction corresponding to said difference length.

According to another preferred embodiment of the present invention, said continuous textile fabric further comprises an additional detectable portion spaced apart by said reference loop length from said first mentioned detectable portion, and said determining step comprises the step of detecting said additional detectable portion by means of second detecting means behind and backward adjacent to said first mentioned detecting means.

Therefore, a principal object of the present invention is to provide an improved continuous processing method adapted to process a continuous textile fabric.

Another object of the present invention is to provide an improved continuous processing method adapted to process a continuous textile fabric successively and spirally set around a squeeze roll assembly from one end to the other end of said squeeze roll assembly, whereby a plurality of loop like portions are formed between the respective adjacent two nipped points of said continuous textile fabric as nipped by said squeeze roll means.

A further object of the present invention is to provide an improved continuous processing method adapted to process a continuous textile fabric successively and spirally set around said squeeze roll assembly from one end to the other end of said squeeze roll assembly, whereby a plurality of loop like portions are formed between the respective adjacent two nip points of said continuous textile fabric as nipped by said squeeze roll assembly, wherein the individual lengths of said loop like portions are corrected or unified while said continuous textile fabric is processed.

Still a further object of the present invention is to provide an improved continuous processing method adapted to process a continuous textile fabric successively and spirally set around a squeeze roll assembly to form a plurality of loop like portions, wherein correction of the individual loop lengths is completed by simply providing said continuous textile fabric with a detectable portion.

According to the present invention, correction of the individual loop length can be achieved with ease and accuracy and automatically in a short time period, while the normal processing is carried out, without degrading productivity.

These and other objects, features, advantages and aspects of the present invention will be better understood when taken in conjunction with the following detailed description of the preferred embodiments made with reference to the accompanying drawings.

DESCRIPTION OF THE PREFERRED EMBODIMENTS

Processing Apparatus

Figure 1:
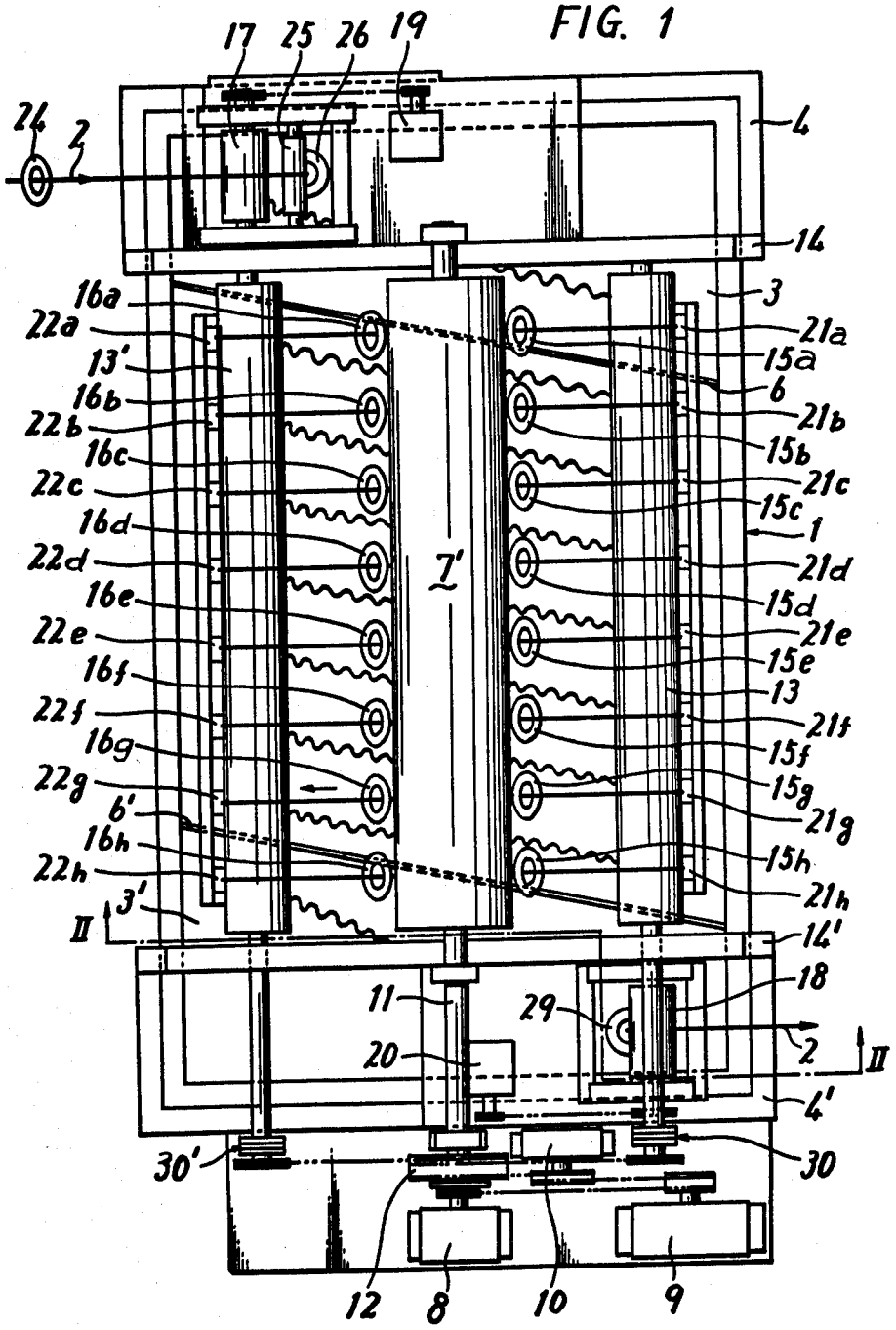
FIG. 1 shows the overall arrangement of a successive processing apparatus for a continuously connected textile fabric for use in practicing the present invention.
Figure 2:
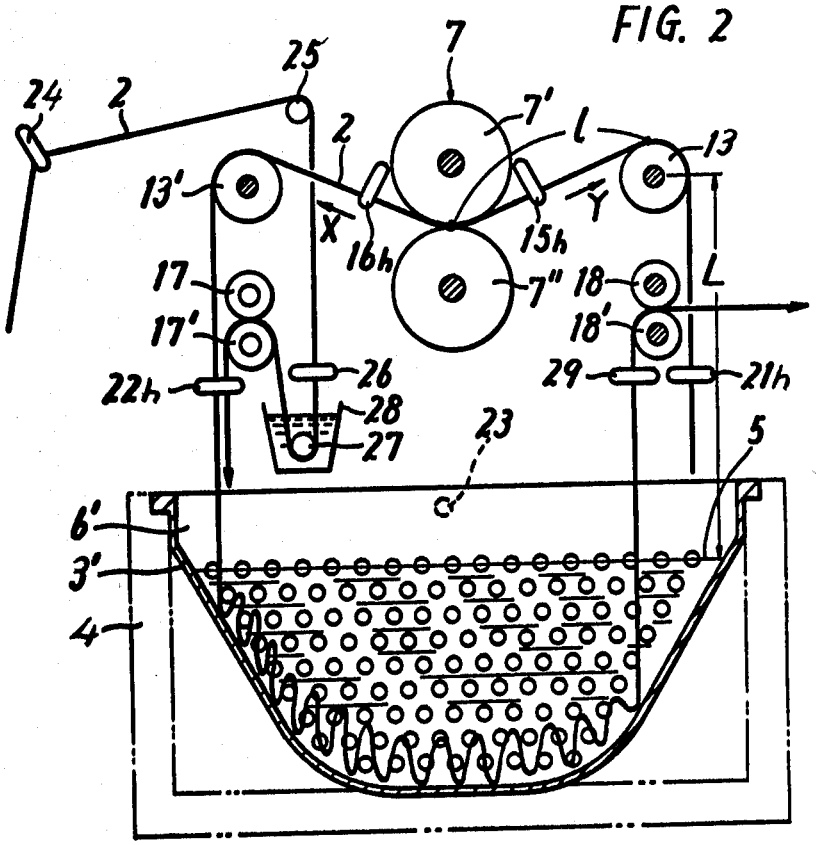
FIG. 2 is a sectional view taken along the line II—II in FIG. 1.

Referring to the drawings, FIG. 1 shows the overall arrangement of a successive processing apparatus for a continuously connected textile fabric, for which the present invention is advantageously employed, and FIG. 2 is a sectional view taken along the line II—II in FIG. 1. The apparatus shown includes a processing chamber 1 containing a processing liquid, and storage chambers 3 and 3' for a material to be processed 2, which is a continuously connected textile fabric, disposed on opposite sides of said processing chamber, these chambers being supported on frames 4 and 4'. The liquid level designated at 5 is maintained the same throughout the three chambers in that partition walls 6 and 6' defining the chambers are perforated. The configuration of the processing chamber is not limited to the one illustrated, but any other suitable configurations may be utilized for the objects of the present invention.

Disposed above the processing chamber 1 is a squeeze roll assembly 7 supported on frames 14 and 14' and consisting of a pair of rolls 7' and 7'', the upper roll 7' being pressed against the lower roll 7'' by press means, not shown. The lower roll 7'' is rotated by a reversibly rotatable driving device 8 through speed reducers 9 and 10 and then through a chain wheel 12 provided on the shaft 11 of the lower roll 7''.

The squeeze roll assembly 7 is arranged so that the amount of feed by forward rotation (in a direction of arrow X shown in FIG. 2 in which the material 2 is forwardly moved) is greater than the amount of feed by backward rotation. In the embodiment, such amount of feed is determined by the number of revolutions of the squeeze roll assembly.

Figure 3:
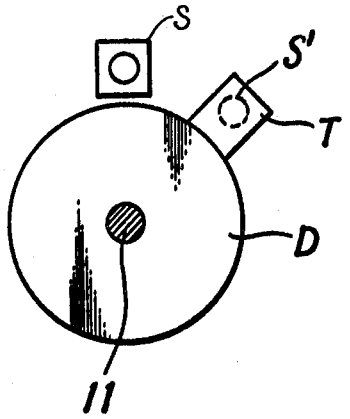
FIG. 3 shows a sensor for detecting the rotation of the shaft of the squeeze role assembly.

Referring to FIG. 3, the shaft 11 of the lower roll 7'' is concentrically provided with a disc D having a projection T to which an object to be detected S' is attached. Further, a sensor (or a proximity switch) S for detecting said object S' is located in the path of rotation of said object S' so that the latter is detected each time the squeeze roll assembly makes one complete revolution, whereby the number of revolutions is counted. The sensor S may be of a contact type, such as a microswitch, so that count may be made each time the projection comes into proximity with the sensor S. Instead of making use of the number of revolutions of the squeeze roll assembly for determination of the amount of feed, it would be possible to use a timer, but the former is more desirable since in the latter case errors or unevennes in action can occur.

Disposed forwardly and rearwardly of the squeeze roll assembly (FIGS. 1 and 2) and above the level of the nip point thereof are guide rolls 13 and 13' supported on the frames 14 and 14'. The guide rolls 13 and 13' are rotated reversibly, i.e., forwardly and backwardly, along with the squeeze roll assembly 7 through the chain wheel 12 on the shaft 11 of the lower roll 7''. During the forward rotation of the squeeze roll assembly 7 (i.e., during the forward travel of the material 2), one guide roll 13' (disposed on the left side as viewed in FIG. 2) serves as a withdrawing roll. Thus, the guide roll 13' on the withdrawing side alone is positively rotated at such a rate that its surface speed is greater than that of the squeeze roll assembly 7, while leaving the other guide roll 13 in a free or idle state by interrupting the transmission of the motion thereto from the chain wheel 12 by means of a clutch 30 adapted to be actuated by a control device, not shown, so that the guide roll 13 may be rotated negatively, or concomitantly with the travel of the material 2. The surface speed of the guide roll 13' on the withdrawing side is selected to be 1.03–1.15 times that of the squeeze roll assembly 7, it being found that a more desirable range is 1.05–1.10. During the backward rotation of the squeeze roll assembly 7 (i.e., during the backward travel of the material 2), one guide roll 13' is rendered free by interrupting the transmission of motion thereto from the chain wheel 12 by means of a clutch 30', while the other guide roll 13 serves as a withdrawing roll, being positively driven with its surface speed exceeding that of the squeeze roll assembly 7.

The purpose of positioning the guide rolls 13 and 13' above the level of the nip point of the squeeze roll assembly 7 and rotating the guide rolls 13 and 13' positively or negatively, as described above, is described in the following. Assume, for example, that when the squeeze roll assembly 7 is forwardly rotated, said other roll 13 is positively rotated. Then, since such guide roll is arranged so that its surface speed is greater than that of the squeeze roll assembly, the material 2 would be overfed over the guide roll 13, resulting in the material 2 sagging between the squeeze roll assembly 7 and the guide roll 13 until it twines around the squeeze roll assembly 7, particularly the lower roll 7''. Thus, the purpose is to prevent such phenomenon. Further, the purpose of making the surface speed of the guide roll 13' on the withdrawing side greater than that of the squeeze roll assembly 7 when the latter is forwardly rotating, is to prevent the material 2 from sagging between the guide roll 13' and the squeeze roll assembly 7. In addition, it is desirable that the distance L between the liquid level 5 in the processing chamber 1 and the guide roll 13 or 13' be at least 2.5 times the distance *l* between the nip point of the squeeze roll assembly 7 and the guide roll 13 or 13'. This arrangement allows the material 2 to be pulled under its own weight, whereby the prevention of sagging of the material 2 between the squeeze roll assembly 7 and the guide roll 13 or 13' is further assured. Further, if the material to be processed is of low "weight," the guide rolls 13 and 13' may be smooth rolls as shown, but if materials of high "weight," such as blanket, are to be processed, it is desirable to use fluted rolls or corrugated rolls for the prevention of slip. A slip-preventive material may be wrapped around the rolls, as the case may be.

A plurality (8, in the embodiment shown) of ring guides **15*a*–15*h* and 16*a*–16*h* are provided between squeeze roll assembly 7 and the guide rolls 13 and 13', respectively. The ring guides 15*a*–15*h* and 16*a*–16*h* are made hollow and each provided with a number of small holes through which a processing liquid is spouted against the material 2 passing through the ring guides in order to improve the condensability of the material and hence to provide for a better squeezing effect. It is so arranged that when the material is moved in the direction of arrow X shown in FIG. 2 by the forward rotation of the squeeze roll assembly 7, the right-hand side ring guides 15*a*–15*h* alone spout the processing liquid, and that when the material is moved to the right, the left-hand side ring guides 16*a*–16*h* alone spout the processing liquid. The purpose of this arrangement is described as in the following. For example, if the left-hand side ring guides 16*a*–16*h* spout the processing liquid when the material 2 is moving in the direction of arrow X, the material would be subjected to a resistance as it passes through said ring guides, resulting in the material sagging between the ring guides 16*a*–16*h* and the squeeze roll assembly 7 until it twines around the squeeze roll assembly 7**. Thus, the purpose is to prevent such phenomenon.

The apparatus shown further includes feed rolls 17 and 17' for the material 2 disposed above one storage chamber 3 and delivery rolls 18 and 18' disposed above the other storage chamber 3'. The feed and delivery rolls are rotated in one direction by motors 19 and 20, respectively, at such a rate that their surface speed is lower than that of the squeeze roll assembly 7.

The apparatus shown further includes lattice-shaped guides **21*a*–21*h* and 22*a*–22*h* disposed below said guide rolls 13 and 13'** respectively, and formed with guide openings through which the material is passed. If, therefore, the material becomes entangled to form a kink before it passes through any of said guide openings, the lattice-shaped guide assembly is lifted by such kink, thereby actuating a detector, not shown, to bring the apparatus to a stop.

A feeler 23 for detecting the material is provided, which, when the portion of the material received in the processing chamber becomes extremely short in length owing to slip, is adapted to be pushed up by said portion, thereby bringing the apparatus to a stop through a detector, not shown.

The apparatus shown further includes guides 24, 25, 26 and 27 disposed on the feed side and a guide 29 disposed on the delivery side. The material 2 to be processed, which is a continuously connected textile fabric, is introduced into the processing apparatus structured in the manner described above, where it is processed.

Normal Processing Mode

Preparatory to the processing, the material is spirally set over and in the processing chamber 1 so as to pass through the squeeze roll assembly 7 over the guide rolls 13 and 13' and through the processing liquid, while at least an amount of material 2 corresponding to the amount of feed by forward rotation of the squeeze roll aseembly 7, i.e., at least the same amount of material 2, as the forward traveling amount of material 2, is stored in each of the storage chambers 3 and 3'.

In this condition, the squeeze roll assembly 7 is rotated forwardly and backwardly by turns to move the material 2 forwardly and backwardly by turns. Eventually, the material 2 is gradually advanced each time by an amount corresponding to the difference between the forward and backward traveling amounts thereof, while the processed portions of the material are stored in the storage chamber 3', from which the preceding processed portions are gradually taken out through the delivery rolls 18 and 18'. The same amount of material as the amount delivered through the delivery rolls 18 and 18' is, of course, fed into the storage chamber 3 on the inlet side by the feed rolls 17 and 17' via the guides 24, 25 and 26 and an immersion bath 28.

Figure 4A:
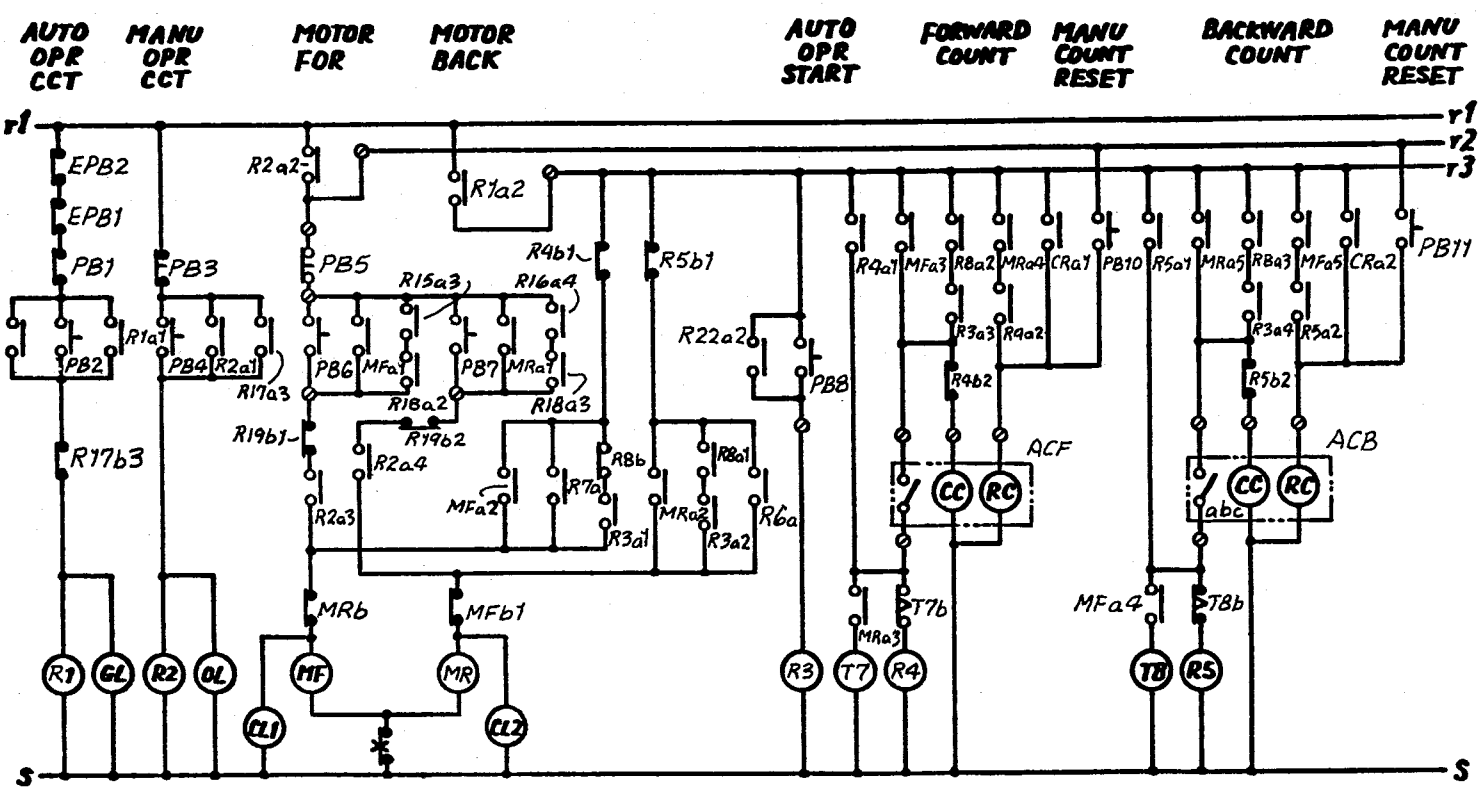
FIGS. 4A and 4B show a schematic diagram of a control circuit for controlling the forward and backward rotation of the squeeze roll assembly.
Figure 4B:
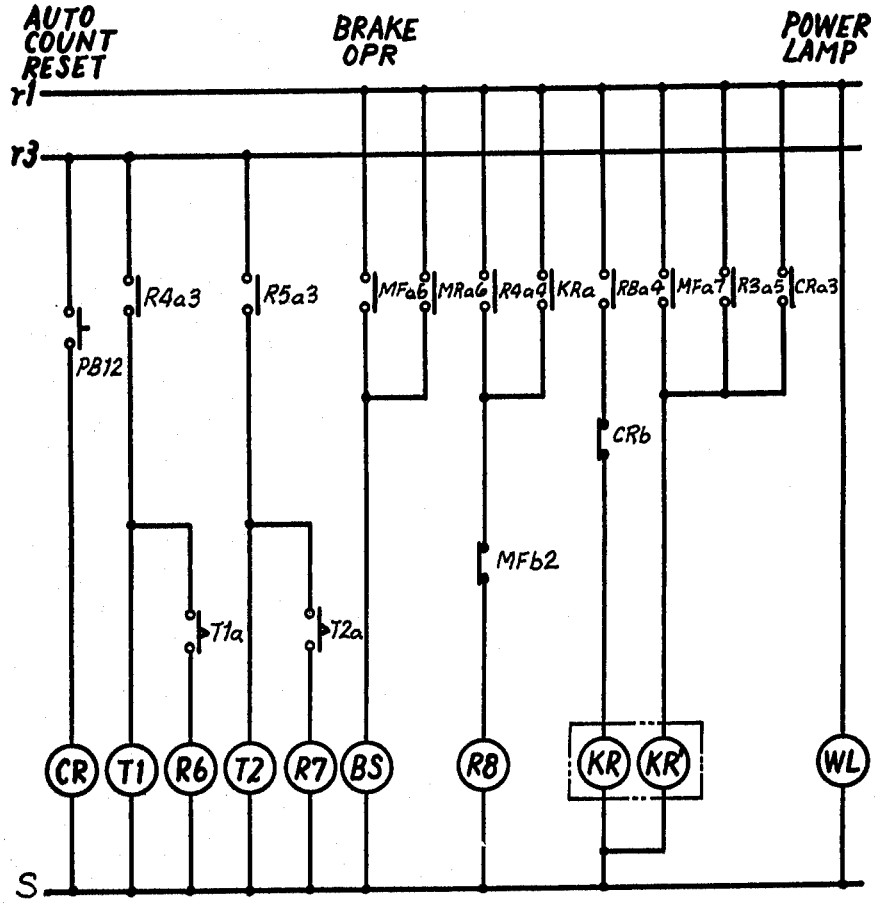

The control of such forward and backward rotation of the squeeze roll assembly, i.e., the control of the forward and backward travel of the material to be processed is accomplished by a control circuit shown in FIGS. 4A and 4B.

The forward and backward rotating operation of the squeeze rolls, and thus the forward and backward control of the material is effected by a control circuit shown in FIGS. 4A and 4B, which comprises various switches, contacts and relays connected between buses *r*1, *r*2 and *r*3 and S in the manner shown. Referring to FIG. 4A, when a start button PB2 is depressed, a relay R1 of an automatic operation circuit is energized, and accordingly the "*a*" contact **R1*a*1 of the relay R1 is turned on, whereby the on state of the relay R1** is self-retained. At the same time the "*a*" contact **R1*a*2 of the relay R1 is also turned on. Next, a push button PB8 for the automatic operation start is depressed, so that a relay R3** is energized, and accordingly the "*a*" contacts **R3*a*1 through R3*a*5** are turned on. Turning on of the "*a*" contact **R3*a*1 causes a manget switch MF for motor forward rotation to be energized, whereby the motor 8 and thus the squeeze roll assembly 7 (FIGS. 1 and 2) is driven to be forward rotated. At the same time as energization of the magnet switch MF, a relay CL1 of the clutch 30' for the guide roll 13' (FIG. 1) is also energized, whereby only one side guide roll 13' out of the guide rolls 13 and 13' is positively rotated. As a result, the material 2 is fed in the forward direction (in the direction of arrow X as seen in FIG. 2**). At that time, energization of the magnet switch MF causes the "*b*" contact Mf*b*1 thereof to turn off, thereby to insure that the operation of the magnet switch MR for motor backward rotation is prevented.

Energization of the magnet switch MF causes the *a* contact MF*a*2 thereof to be turned on, whereby the magnet switch MF is self-retained, when the *a* contacts MF*a*1, MF*a*3 through MF*a*7 are also turned on and the "*b*" contact MF*b*2 is turned off. It is pointed out that the a contact MF*a*1 is a contact of a manual circuit. The turning on of the contact MFa3 causes a count coil CC of a forward counter ACF to be energized, whereby the number of rotations of the squeeze rolls 7 and 7' in the forward direction is counted using the detecting output from the switch shown in FIG. 3.

Turning on of the a contact MF*a*6 (FIG. 4B) causes a brake switch BS of the motor to be energized, whereby the brake (not shown) is disengaged. If and when the number of forward rotations of the motor reaches a preset number in the counter ACF, a switch acf is turned on, whereby a relay R4 for stopping the forward rotation is energized.

Energization of the relay R4 causes the "*b*" contact R4b1 to be turned off, whereby the magnet switch MF for motor forward rotation is deenergized to deenergize the motor 8 and thus to stop the forward rotation of the squeeze rolls, when the "*a*" contact MF*a*6 (FIG. 4B) of the manget switch MF is turned off, whereby the brake switch BS is deenergized, thereby to engage the brake not shown. On the other hand, the "*b*" contact R4*b*2 is turned off, whereby the forward rotation count coil CC is deenergized. At the same time, the "*a*" contact **R4*a*1 of the relay R4 is turned on, whereby the relay R4** is self-retained, while the "*a*" contacts **R4*a*2 through R4*a*4 thereof are also turned on. Turning on of the a contact R4*a*3 causes a timer T1** for delay of backward rotation command to be energized, so that the "*a*" contact **T1*a* is turned on after the lapse of a predetermined delay time, whereby a relay R6 for backward rotation command is energized. Energization of the relay R6** causes the "*a*" contact **R6*a* to be turned on, whereby a magnet switch MR for backward rotation of the motor 8** is energized through the "*b*" contact MF*b*1 of the magnet switch MF being closed at that time, with the result that the motor 8 and thus the squeeze roll assembly are backward driven. At the same time as energization of the magnet switch MR, a relay CL2 of the clutch 30 for the guide roll 13 (FIGS. 1 and 2) is also energized, whereby only one side guide roll 13 out of the guide rolls 13 and 13' is positively rotated, with the result that the material 2 is fed in the backward direction (the direction of arrow Y as seen in FIG. 2). Since the magnet switch MR is energized, the "*b*" contact MR*b* thereof is turned off, thereby to insure that the operation of the magnet switch MF for motor forward rotation is prevented.

Energization of the manget switch MR causes the "*a*" contact MR*a*2 thereof to be turned on, whereby the magnet switch MR is self-retained, while the "*a*" contacts MR*a*1 and MR*a*3 through MR*a*6 thereof are also turned on. It is pointed out that the a contact MR*a*1 is a contact of a manual circuit. Since the "*a*" contact MR*a*4 is turned on, a reset coil RC of the counter ACF for forward rotation is energized through the "*a*" contact MR*a*4 of the magnet switch MR and the "*a*" contact R4*a*2 of the relay R4, whereby the counter ACF is reset.

When the a contact MR*a*5 of the manget switch MR is turned on, the count coil CC of a counter ACB for backward rotation is energized, whereby the number of backward drive rotations is counted. The preset number in the forward rotation counter ACF is selected to be larger than the preset number in the backward rotation counter ACB.

Since the a contact MRa3 of the magnet switch MR has been turned on, a timer T7 is energized through the closed "*a*" contact MR*a*3 of the magnet switch MR and the "*a*" contact R4a1 of the relay R4, whereby the "*b*" contact **T7*b* of the timer T7 is turned off and thus the relay R4 is deenergized after the lapse of the delay time of the timer T7**. Since the "*a*" contact MR*a*6 (FIG. 4B)

of the magnet switch MR is turned on, the brake switch BS is also energized, whereby the brake is disengaged.

If and when the number of backward rotations of the motor 8 (FIG. 1) reaches the preset number in the counter ACB, the switch *acb* of the counter ACB is turned on, whereby the relay R5 for stopping the backward rotation is energized. Energization of the relay R5 causes the "*b*" contact R5b1 to be turned off, whereby the magnet switch MR for backward rotation of the motor 8 is deenergized, with the result that the backward drive of the motor 8 and thus of the squeeze rolls is stopped, when the "*a*" contact MR*a*6 of the magnet switch MR is turned on and thus the brake switch BS is turned off (FIG. 4B), thereby to engage the brake not shown. Since the "*b*" contact R5*b*2 of the relay R5 is turned off, the count coil CC for backward rotation is deenergized. At the same time, the "*a*" contact R5*a*1 of the relay R5 is turned on, whereby the relay R5 is self-retained, while the "*a*" contacts R5*a*2 and R5*a*3 of the relay R5 are also turned on. Turning on of the "a" contact R5*a*3 of the relay R5 causes a timer T2 for delay of forward rotation command to be energized, whereby the "*a*" contact T2*a* of the timer T2 is turned on and thus the relay R7 for forward rotation command is also energized after the lapse of the delay time of the timer T2.

Energization of the relay R7 causes the "*a*" contact R7*a* to be turned on, whereby the magnet switch MF for motor forward rotation is turned on through the closed "*b*" contact R4*b*1 of the relay R4 and the "*b*" contact MR*b* of the magnet switch MR, with the result that the forward rotation of the motor 8 and thus of the squeeze rolls is regained. The relay R5 for stopping the backward rotation is deenergized, if and when the *b* contact T8*b* is turned off after the delay time of the timer T8 since the timer T8 is turned on through the closed "*a*" contact MF*a*4 as a result of energization of the magnet switch MF and through the closed "*a*" contact R5*a*1 of the relay R5.

Thereafter the above described operation is repeated to successively process the material, while the material is transferred in turn in the forward direction by the difference between the feeding amounts of the material in the forward and backward rotations of the motor 8 and thus of the squeeze roll assembly 7.

It is pointed out that the FIGS. 4A and 4B circuit is shown comprising a push button PB1 for stoppage, push buttons EPB1 and EPB2 for emergency stoppage, a start push button PB4 of the manual operation circuit, a relay R2 for the manual operation circuit comprising the "*a*" contacts R2*a*1 through R2*a*4, a push button PB3 for stoppage, push buttons PB6 and PB7 for forward drive and rearward drive, respectively, of the motor 8, a push button PB5 for stoppage, a push buttons PB10 and PB11 for resetting the counter in the manual operation circuit, a relay CR comprising the "*a*" contacts CR*a*1 through CR*a*3 and the "*b*" contact CRb, and display lamps GL, OL and WL. The FIGS. 4A and 4B circuit is shown further comprising relays R8 and KR each serving to function as a keep relay for keeping the driving direction if and when the machine is emergency stopped by occurence of power failure during the forward or backward driving or unforeseeable troubles. These relays serve to maintain in a normal condition the relation between the feeding amount in the forward direction and the feeding amount in the backward direction when the machine starts again to operate, thereby to achieve the operation in accordance with the predetermined program. By way of an example, let it be assumed that in the course of processing in accordance with the program for the number of forward drives being 60 and the number of backward drives being 50 power failure occurs at the number of backward drives of 29. Since the relay KR remains on until the subsequent start of operation, the operation of the machine starts in the backward direction when the power is recovered and the machine starts to operate. Thus the count proceeds as 31, 31, . . . 50, whereupon the direction of drive is changed to the opposite direction i.e. to the forward direction. Thus it is appreciated that when power is recovered after the power failure, the relay KR is energized and thus the relay R8 is energized as a result of closing of the "*a*" contact KR*a* of the relay KR, whereupon the push button PB2 is depressed so that the relay R1 is energized. Thereafter the push button PB8 is depressed so that the relay R3 is energized, with the result that the magnet switch MR is energized, i.e. the operation is restarted from the backward direction, in the above described example.

As described above, with the apparatus shown in FIGS. 1 and 2, the material 2 undergoes an effective treatment through a smaller number of steps. In such apparatus, however, the material to be processed nipped by the squeeze roll assembly 7 often slips during its travel and the amounts of slip at the individual nip points differ from each other. As a result, a prolonged processing of the material would cause the distance between adjacent nipped points on the material to vary to the extent of bringing about an undesirable situation. The length of a portion of the material set between adjacent nip points will be hereinafter referred to as "loop length" in view of the fact that said portion forms an approximate loop. Accordingly, the present invention is intended to correct or regulate the individual loop lengths before an extreme variation in such loop length takes place. The implementation in this respect will now be described with reference to FIGS. 5 through 17.

Loop Length Correcting Apparatus

Figure 5:
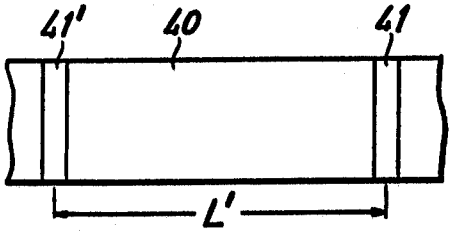
FIG. 5 schematically shows a loop length correcting cloth used for correcting the loop lengths of the material to be processed.

FIG. 5 schematically shows a loop length correcting cloth 40 (hereinafter referred to as "leader cloth") used for embodying the present invention. The leader cloth 40 is provided in advance with two detectable portions 41 and 41' spaced apart a predetermined distance L' corresponding to a predetermined loop length of the material. To form the detectable portions 41 and 41', metallic foils, metallic yarns, fluorescent-dyed yarns, metal netting and the like may be used, but in the embodiment, aluminum foils are placed on the leader cloth 40 across the cloth, or copper wire rings are, arranged on the leader cloth 40 at the opposite ends in successively mutually displaced relation across the cloth, and another cloth is then placed thereover, the resulting sandwich being machine-sewn. For the purpose of correcting the individual loop lengths before an extreme variation in such loop length takes place, the continuous textile fabric 2 is severed at the introduction side of the processing chamber 1 and the leader cloth 40 is connected between the severed continuous textile fabric 2.

Figure 6:
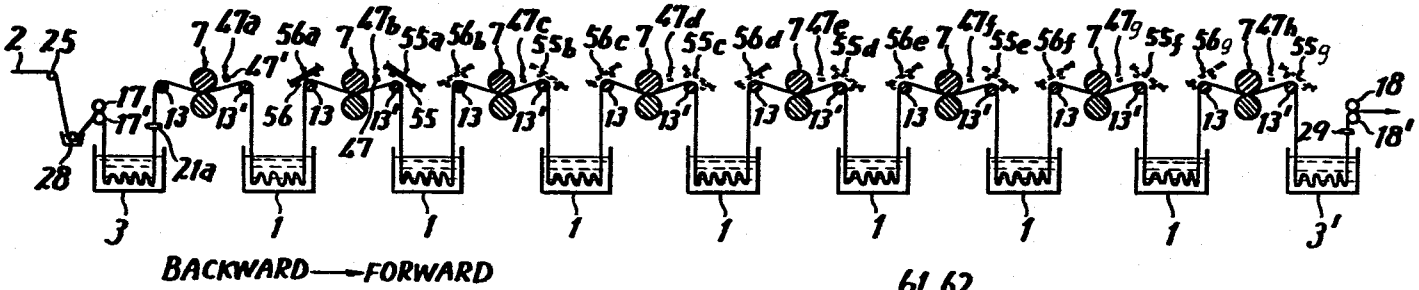
FIG. 6 is a view of the apparatus of FIGS. 1 and 2, shown developed with respect to the material being processed for the convenience of explanation, provided with loop length regulating means.
Figure 8:
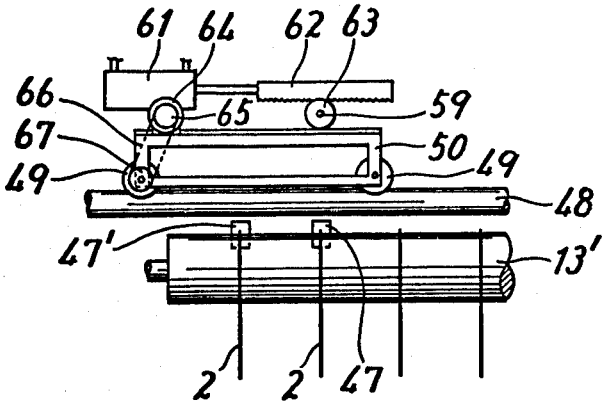
FIG. 8 is a partial front view of the FIG. 7 arrangement.

FIG. 6 is a view of the apparatus of FIGS. 1 and 2, shown developed with respect to the material being processed for the convenience of explanation, provided with loop length regulating means according to the present invention. There are provided detectors 47 and 47' for detection of the detectable portions 41 and 41' attached to the ends of the leader cloth 40, two such detectors being disposed in the path of travel of the material 2 (in the illustrated example, between the squeeze roll assembly 7 and the guide roll 13') spaced apart the same distance as the distance between adjacent loops of the material 2 as spirally set around the rolls 13', 7 and 13, as seen in FIG. 8 to be described subsequently.

Figure 7:
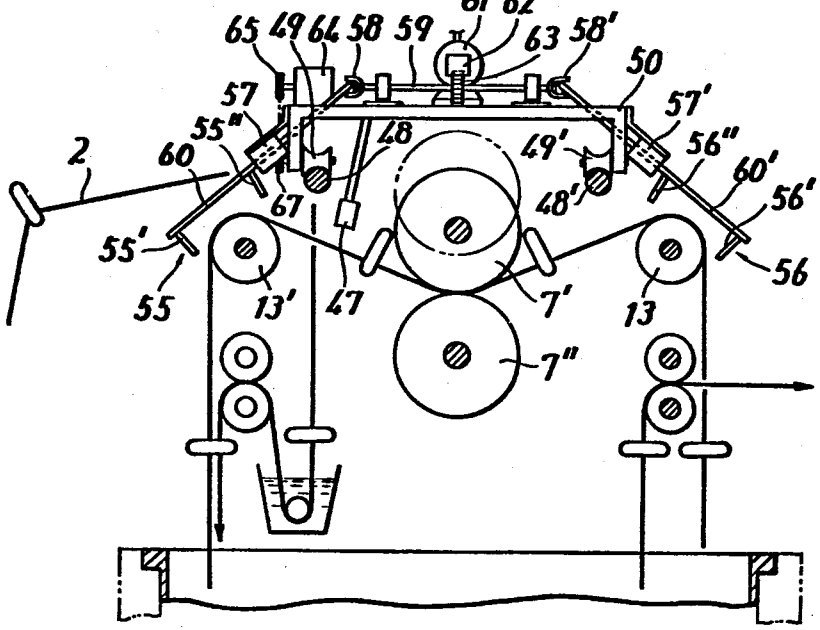
FIG. 7 shows a sectional view of the principal arrangement of loop length correcting means used in the present invention.

Referring to FIG. 7, there is shown in a sectional view the principal arrangement of loop length correcting means used in the present invention. FIG. 8 is a partial front view of the FIG. 7 arrangement. As shown in FIGS. 7 and 8, the detectors 47 and 47' are attached to a carriage 50 with wheels 49 and 49' mounted on rails 48 and 48' installed above the processing chamber 1, which rails are implemented in the embodiment by stays mounted on the machine frame, so that as the carriage 50 travels the detectors 47 and 47' are moved axially of the squeeze roll assembly 7. To this end, the wheel 49 is adapted to be driven for rotation by a motor 64 fixed on the top of the carriage 50. In FIG. 6, the respective positions assumed by the detector 47 with respect to the squeeze roll assembly 7 as the detector 47 is moved, are designated at 47*a*–47*h*.

The detectors 47 and 47' are proximity switches of the eddy current type in the case where the detectable portions 41 and 41' are in the form of metallic foils; they are those of the iron detection type in the case where the detectable portions are in the form of metallic yarns or metallic netting; and they are those of the fluorescence detection type in the case where the detectable portions are in the form of fluorescent-dyed yarns. In the embodiment, proximity switches are used, the arrangement being such that when either of the detectors 47 and 47' is actuated, the machine is brought to a stop. Alternatively, the detectors 47 and 47' may be attached to another position, for example, below the guide rolls.

Referring to FIGS. 6 and 7, the machine shown includes two-finger fork shaped stoppers 55 and 56 for stopping, by taking up the material, the travel of the corresponding portion of the material when the detectable portion 41 is detected by the detector 47 in the loop length correcting mode. The detail of the structure and operation of the stoppers will be later described. The stoppers are disposed in the path of travel of the material 2 (in the illustrated example, above the guide rolls 13 and 13').

Figure 9:
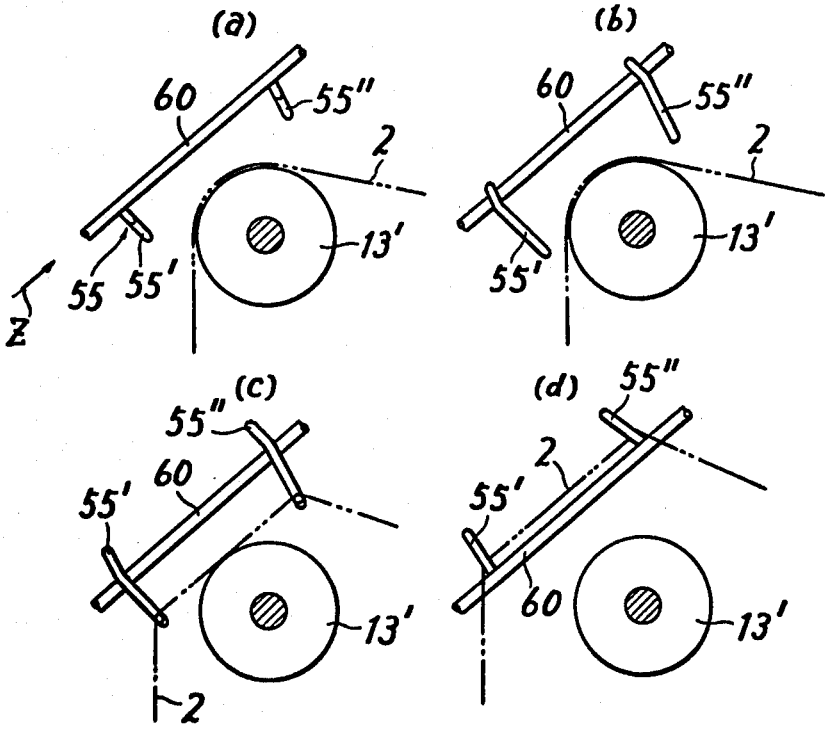
FIGS. 9 and 10 illustrate the successive steps of operation of the stoppers, FIG. 9 showing only one of the stoppers and FIG. 10 showing a view taken in the direction of arrow Z in FIG. 9.
Figure 10:
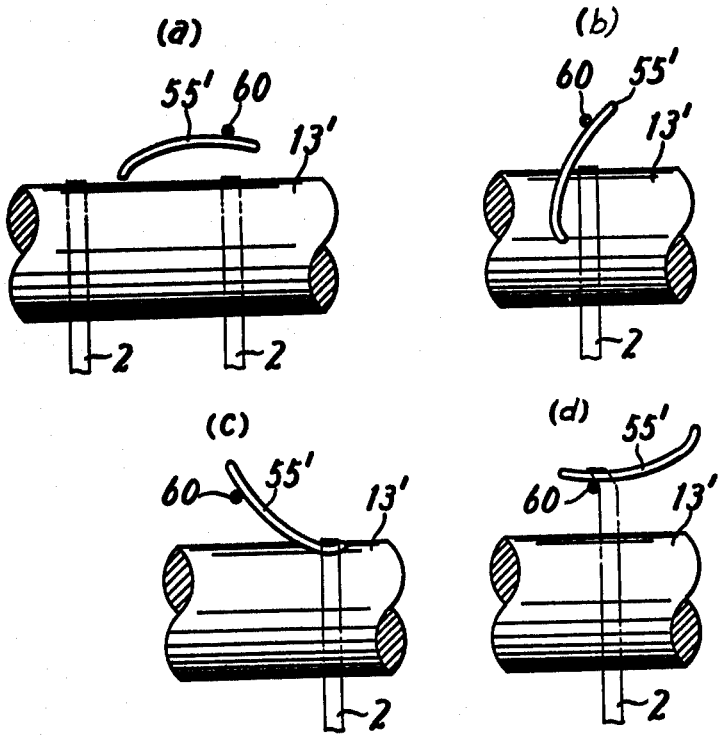

The successive steps of operation of the stoppers 55 and 56 are illustrated in FIGS. 9 and 10. FIGS. 9 and 10 show one stopper 55 only, FIG. 10 being a view taken in the direction of arrow Z in FIG. 9. Referring to FIGS. 7, 9 and 10, two-finger fork shaped stoppers 55 and 56 are constituted of pairs of fingers or hooks 55', 55'' and 56', 56'', respectively, each pair being spaced apart a distance greater than the diameter of the guide rolls 13 and 13', the arrangement being such that in the loop length correcting operation mode said hooks are rotated by rotatable means to be later described so as to take up and catch the corresponding portion of the material 2 and pull it apart from the guide roll 13 and 13' (see FIGS. 9 and 10), thereby selectively stopping the travel of only the corresponding portion of the material.

Referring to FIG. 7, the stoppers 55 and 56 are fixed to shafts 60 and 60', respectively, which extend through bearings 57 and 57' attached to the carriage 50 toward a position above the rolls 13' and 13, respectively, and which are connected through universal joints 58 and 58' to a shaft 59 disposed over the carriage 50.

Referring to FIGS. 7 and 8, the shaft 59 on the carriage 50 is provided with a pinion 63 engaging a rack 62 and for providing movement to the plunger of a cylinder 61 fixed to the carriage 50, so that rotation of the pinion 63 causes the stoppers 55 and 56 to be rotated together. As the carriage 50 travels axially of the squeeze roll assembly 7, the stoppers 55 and 56 as well as the detectors 47 and 47' are moved. Referring to FIG. 6, the positions assumed by the stoppers 55 and 56 with respect to the corresponding regions of the squeeze roll assembly 7 during the movement of said stoppers are designated at 55*a*–55*g* and 56*a*–56*g*. It is to be pointed out that the hooks used as the stoppers 55 and 56 are not limited in configuration and in number to what is illustrated.

A reversible motor 64 is mounted on the carriage 50 so that the drive of the motor 64 causes a wheel 49 to be rotated through a pulley 65 mounted on the motor shaft, a chain 66 and a pulley 67 being provided coaxially to the wheel 49 to causes the carriage 50 to be moved in the axial direction of the squeeze roll assembly 7. Although the embodiment shown has been structured such that the stoppers 55 and 56 and the detectors 47 and 47' are all moved together, it may be arranged such that these are separately moved by means of any suitable means for that purpose.

Loop Length Correcting Mode (1)

The loop length correction is performed by a control circuit whose electrical operation will be later described. Accordingly, the mechanical operation for loop length correction will now be described with reference to FIG. 6. When it is desired to correct or unify the individual loop lengths, the machine is first brought to a stop in advance, the textile fabric 2 is severed at the introduction side of the processing chamber 1 and the leader cloth 40 having detectable portions 41 and 41', as shown in FIG. 5, is connected to the continuous textile fabric 2. With the upper roll 7' of the squeeze assembly 7 maintained in its lifted position (see FIG. 7), the detectors 47 and 47' are placed at the positions 47*b* and 47*a* and the stoppers 55 and 56 are placed at the positions 55*a* and 56*a*, while the detectors 47 and 47' are placed in an enabled or active state. Now, assume that the loop lengths before the loop length correction, i.e., in the embodiment shown, the "loop lengths" of the material extending between adjacent detector positions, as specifically defined previously, are 25m, 45m, 25m, 25m, 45m, 25m and 25m, respectively, in the order beginning from the inlet side, and that the preselected distance L' between the detectable portions 41 and 41' is 35m, which means that the prescribed ideal reference loop length is 35m.

Under these conditions, the apparatus is made to operate in the same manner as discussed in the normal processing mode such that the textile fabric 2 is conveyed forward and backward by turns while it is processed, and fed in the forward direction ultimately as described in the normal processing mode. However, if and when the leading portion 41 of the detectable portions 41 and 41' reaches the leading side detector 47 of the two detectors 47 and 47' provided along the feeding path of the textile fabric 2 and is detected thereby during the travel of the textile fabric in the forward direction, the machine is stopped, whereby the squeeze roll assembly 7 and the guide rolls 13 and 13' are stopped. After the machine is stopped, the upper roll 7' of the squeeze roll assembly 7 is lifted so as to be separated from the lower roll 7'', whereby the squeeze roll assembly 7 is in a disabled state. In this condition, the stoppers 55 and 56 are driven in the manner shown in FIGS. 9 and 10 to take up or pull the corresponding portion of the textile fabric 2 apart from the guide rolls 13 and 13', thereby to keep the said corresponding portion of the textile fabric in a stop state.

In such a state, a machine start switch (not shown) is depressed, whereby the machine is started again and thus the guide roll 13' causes the textile fabric to travel. However, the portion of the textile 2 caught by the stoppers 55 and 56 is maintained at rest. Since it is assumed that the first loop length is shorter than the prescribed loop length, the leading detectable portion 41 reaches the detector 47 located at the position 47*b* before the trailing detectable portion 41' reaches the detector 47' located at the position 47*a*. Therefore, as for the first loop length portion, the guide roll 13' is driven in the forward direction so that the textile fabric 2 is fed in the forward direction, while the portion of the textile fabric caught by the stoppers 55 and 56 at the positions 55*a* and 56*a* is separated from the guide rolls 13 and 13' so that the said portion is maintained at rest. If and when the trailing detectable portion 41' reaches the detector 47' located at the position 47*a* and is detected thereby, the machine is stopped again and hence the squeeze roll assembly 7 and the guide rolls 13 and 13' are brought to a stop. Now it follows that the regulation or correction of the first loop length corresponding to the leader cloth 40 has been completed.

Upon completion of correction of the first loop length, the stoppers 55 and 56 are driven so as to be brought to the original position, as shown in FIGS. 9(*a*) and 10(*a*), whereby the textile fabric is brought back to its original state where it is set around the guide rolls 13 and 13', and the detectors 47 and 47' are moved to the positions 47*c* and 47*b*, respectively, while the stoppers 55 and 56 are moved to the positions 55*b* and 56*b*, respectively. The upper roll 7' of the squeeze roll assembly 7 is also brought back to the original position.

The machine is driven again to perform the second loop length correction, while the textile fabric 2 is fed in the forward direction. In this case, however, since the second loop length is longer than the prescribed length, the trailing detectable portion 41' reaches the detector 47' located at the position 47*b* before the leading detectable portion 41 reaches the detector 47 located at the position 47*c*. Despite the detection by the detector 47', however, the machine is continually driven without being stopped, until the leading detectable portion 41 reaches the detector 47 located at the position 47*c*, whereupon the machine is stopped and hence the travel of the textile fabric is stopped, whereupon the stoppers 55 and 56 are actuated to pull the corresponding portion of the textile fabric apart from the guide rolls 13 and 13' to maintain the said portion at rest.

In such a state, the machine is driven again this time in the direction opposite to the preceding one, i.e. in the backward direction, inasmuch as the second loop length is longer than the prescribed loop length, as described previously. In this case, therefore, the guide roll 13 is positively driven so that the textile fabric is caused to travel in the backward direction. At that time, the portion of the textile fabric caught by the stoppers 55 and 56 at the positions 55*b* and 56*b*, respectively, is kept separated apart from the guide rolls 13 and 13' and is maintained at rest. If and when the trailing detectable portion 41' reaches the detector 47' located at the position 47*b*, while the remaining textile fabric 2 is traveling in the backward direction, the machine is stopped in response to the detection by the detector 47', thereby to stop the travel of the textile fabric. The correction of the second loop length is thus completed. The stoppers 55 and 56 are then operated in the direction opposite to the preceding one so as to bring the textile fabric to its original state and the detectors 47 and 47' and the stoppers 50 and 56 are moved to the following positions for the third loop length.

The correction of the subsequent loop lengths is similarly performed, and when all the loop lengths are corrected, the guide rolls 13 and 13' are stopped and the detectors 47 and 47' are rendered in an unoperable or inactive state.

Figure 11:
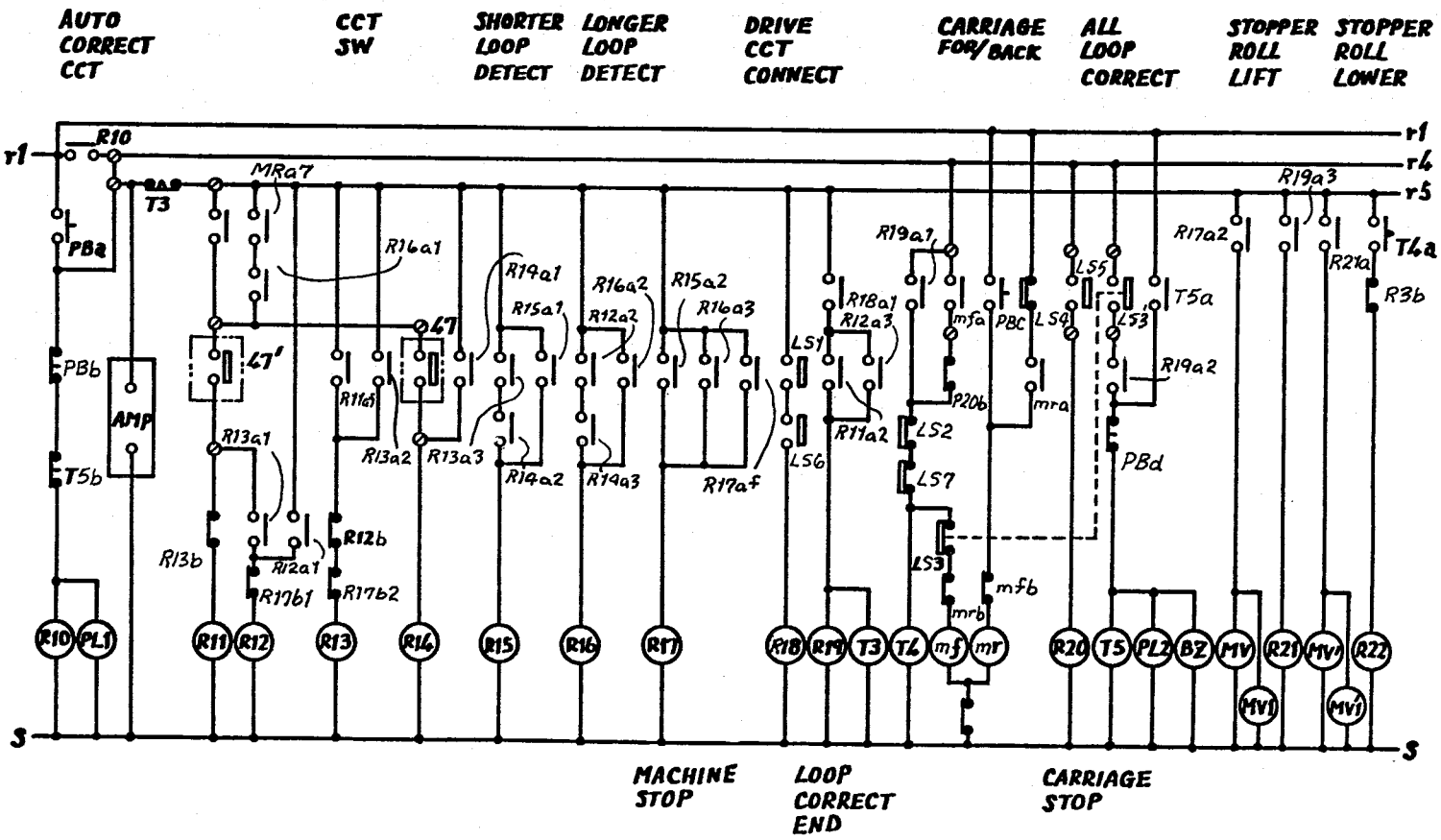
FIG. 11 is a schematic diagram of one embodiment of a loop length correcting circuit for controlling the operation of the loop length correcting apparatus shown in FIGS. 7 through 10.

FIG. 11 is a schematic diagram of loop length correcting circuit for controlling the operation of the loop length correcting apparatus shown in FIGS. 7 through 10. The FIG. 11 circuit comprises various switches, contacts and relays connected between buses *r*1, *r*4 and *r*5 and S in the manners shown. It is pointed out that, in accordance with the present invention, the loop length correcting operation is effected simultaneously with the normal pocessing mode effected by means of the control circuit shown in FIGS. 4A and 4B. Hence, when it is desired to correct the individual loop lengths of the textile fabric, the leader cloth 40 is connected between the trailing end of the textile fabric remaining in the processing chamber 1 at the introduction side of the processing chamber 1 and the leading end of the textile fabric to be processed subsequently. On the other hand, the detectors 47 and 47' are brought to the positions 47*b* and 47*a* and the stoppers 55 and 56 are brought to the positions 55*a* and 56*a*, as shown in FIG. 6, by way of an initial condition. Further let it be assumed that the loop lengths i.e. in the embodiment shown, the "loop lengths" of the textile fabric extending between adjacent detector positions are 25m, 45m, 25m, 25m, 45m, 25m, and 25m, respectively, in the order beginning at the introduction side of the processing chamber 1 and the predetermined distance L' between the detectable portions 41 and 41' of the leader cloth is 35m, which means that the prescribed ideal reference loop length is 35m.

On the assumption of the above described initial condition for the loop length correcting operation, the operation of the loop length correcting circuit will be described in the following. For the purpose of initiation of the loop length correcting mode, a push button PB*a* of the FIG. 11 circuit is depressed, whereby "*a*" relay R10 is energized and the *a* contact R10*a* is turned on. As a result an amplifier AMP for the detectors 47 and 47' is energized and thus the detectors 47 and 47' are placed in an operable or active state.

The textile fabric 2 is transferred forwardly and rearwardly by turns while it is processed in the processing chamber, as described previously by way of the normal processing mode, and the leading portion 41 of the detectable portions 41 and 41' of the leader cloth 40 comes to pass the detector 47' located at the position 47*a* during the forward feeding operation, when the detector 47' is closed in response to the leading detectable portion 41. Since the motor forward driving magnet switch MF has been energized, as described previously with reference to FIG. 4A, and the "*a*" contact MF*a*8 has been closed, a detector relay R11 is energized and the "*a*" contacts R11*a*1 and R11*a*2 are turned on. Turning on of the "*a*" contact R11*a*1 causes a detected signal switching relay R13 to be energized and to be self-retained by turning on the contact R13*a*2 of the relay R13. The textile fabric continues to be fed until the preset count number is reached by the counter ACF in such a state. However, since the first loop length is shorter than the prescribed loop length, the leading detectable portion 41 of the leader cloth 40 reaches the detector 47 located at the position 47*b* before the trailing detectable portion 41' of the leader cloth 40 reaches the detector 47' located at the position 47*a*, whereby a detector relay R14 is energized. Energization of the relay R14 is self-retained by turning on the "*a*" contact R14*a*1 of the relay R14. Since the "*a*" contacts R13*a*3 and R14*a*2 are closed because of the above described energization of the relays R13 and R14, a shorter loop detecting relay R15 is energized and the "*a*" contacts R15*a*1 and R15*a*2 are turned on. Turning on of the "*a*" contact R15*a*1 causes the relay R15 to be self-retained and turning on of the "*a*" contact R15*a*2 causes a machine stopping relay R17 to be energized.

Since the relay R17 is energized, the "*b*" contact R17*b*3 (see FIG. 4A) is turned off, whereby the relay R1 for the automatic operation circuit (see FIG. 4A) is deenergized. As a result, the "*a*" contact R1*a*2 is turned off and accordingly the forward driving magnet switch MF is deenergized. Accordingly, the motor 8 is deenergized and the forward drive of the squeeze roll assembly 7 is stopped. The relay R17 is self-retained due to the turning on of the "*a*" contact R17*a*1. The "*a*" contact R17*a*3 is also turned because of energization of the relay R17, which causes the manual operation circuit relay R2 (see FIG. 4A) be energized. At the same time the "*b*" contact R17*b*2 is turned off and the self-retention of the relay R13 is released. The "*a*" contact R17*a*2 is also turned on and a one side magnetic valve MV1 of a cylinder (not shown) for lifting the upper roll 7' of the squeeze roll assembly 7 is energized, whereby the upper roll 7' is lifted so as to be separated from the lower roll 7''. Simultaneously with the energization of the magnetic valve MV1, a one side magnetic valve MV of the cylinder 61 shown in FIGS. 7 and 8 is energized, whereby the rack 62 provided for to and fro movement to the cylinder 61 is moved backward and the stoppers 55 and 56 are rotated, with the result that the corresponding portion of the textile fabric is separated from the guide rolls 13 and 13'.

If and when the upper roll 7' reaches the uppermost position, a limit switch LS6 provided at the said uppermost position is depressed so as to be turned on. On the other hand, if and when the stoppers 55 and 56 are rotated to reach the uppermost position, a limit switch LS1 provided at the said uppermost position is depressed so as to be turned on. As a result, a drive circuit operating relay R18 is energized. The relay R18 is kept energized, so long as the limit switches LS6 and LS1 are depressed. When the "*a*" contact R18*a*2 is turned on because of energization of the relay R18, the above described relay R2 has been energized and accordingly "*a*" contacts R2*a*2 and R2*a*3 have been turned on, and the above described relay R15 has been energized and accordingly the "*a*" contact R15*a*3 has been turned on. Therefore, the forward driving magnet switch MF and the clutch relay CL1 is energized, when the upper roll 7' of the squeeze roll assembly 7 has been separated from the lower roll 7''. In this case, therefore, the textile fabric is transferred by means of the guide roll 13'. In other words, the textile fabric is transferred again in the forward direction, while the corresponding portion of the textile fabric separated by means of the stoppers 55 and 56 located at the positions 55*a* and 56*a* apart from the guide rolls 13 and 13' is maintained at rest.

During the feeding operation in the forward direction of the remaining portion of the textile fabric, the trailing detectable portion 41' of the leader cloth 40 reaches the detector 47' located at the position 47*a*, when the "*a*" contact MF*a*8 of the magnet switch MF is turned on. Since the "*b*" contact R13*b* of the relay R13 has been turned on at that time, the relay R11 is energized, whereby the "*a*" contact R11*a*2 is turned on. Since the "*a*" contact R18*a*1 of the relay R18 has been turned on, as described previously, a relay R19 is energized and simultaneously a timer T3 is also energized.

Energization of the relay R19 causes the "*b*" contact R19*b*1 to be turned off and accordingly causes the magnet switch MF and the clutch relay CL1 to be deenergized, whereby the lower roll 7'' of the squeeze roll assembly 7 and the guide roll 13' are acted upon so as to stop the forward drive. The textile fabric is thus caused to stop the forward travel. Now it follows that correction of the first loop length is completed.

Energization of the relay R19 also causes the "*a*" contact R19*a*3 to be turned on, which serves to energize a relay 21 for returning the upper roll 7' of the squeeze roll assembly 7' and the stoppers 55 and 56. Energization of the ralay R21 causes the "*a*" contact R21*a* to be turned on, which serves to energize the magnetic valves MV1' and MV' on the other side of the cylinder for lifting the squeeze roll and the cylinder 61 for rotating the stoppers, whereby the upper roll 7' of the squeeze roll assembly 7 is lowered to be brought in contact with the lower roll 7'' and the rack 62 is moved forward. As a result, the stoppers 55 and 56 are rotated in the direction opposite to the former and the corresponding portion of the textile fabric is again positioned over the guide rolls 13 and 13'. The timer T3 is energized simultaneously with the energization of the relay R19 and the "*b*" contact T3*b* is turned off after the lapse of the delay time period set by means of the timer T3, whereby the detecting circuit is turned off. Turning off of the detecting circuit causes the relay R17 to be deenergized, whereby the "*a*" contact R17*a*3 is turned off and the relay R2 for the manual operation circuit (see FIG. 4A) is deenergized.

Their stoppers 55 and 56 are returned to the original position, as shown in FIGS. 9(a) and 10(a), and the upper roll 7' of the squeeze roll assembly 7 is also returned to its original position, when the limit switches LS2 and LS7 provided at the corresponding positions, respectively, are depressed so as to be turned on. Since at that time the "*a*" contact R19*a*1 of the relay R19 has been turned on, the timer T4 is energized and simultaneously with energization of the timer T4 a relay *mf* for forward drive of the motor 64 for driving the carriage 50 shown in FIGS. 7 and 8 is energized. Energizaton of the relay *mf* causes the "*a*" contact *mfa* to be turned on, thereby to self-retain the relay *mf*. As a result, the carriage 50 is moved to the following loop length position.

It is pointed out that the preset delay time period of the timer T3 is selected such that the "*b*" contact T3*b* of the timer T3 is turned off after the upper roll 7' of the squeeze roll assembly 7 and the stoppers 55 and 56 have been returned to their original positions.

If and when the carriage 50 is moved and accordingly the detectors 47 and 47' and the stoppers 55 and 56 are moved to reach the detector positions 47*c* and 47*b* and the stopper positions 55*b* and 56*b*, respectively, the limit switch LS5 is turned on, whereby the carriage stopping relay R20 is energized. Energization of the relay R20 causes the "*b*" contact R20*b* be turned off, whereby the relay *mf* is deenergized and the motor 64 is caused to stop the forward drive, with the result that the carriage 50 is stopped.

Simultaneously with energization of the relay *mf*, the timer T4 is also energized and the "*a*" contact T4*a* of the timer T4 is turned on after the lapse of a predetermined delay time period, whereby a relay R22 is energized. Energization of the relay R22 makes the "*a*" contacts R22*a*1 and R22*a*2 (see FIG. 4A) be turned on, whereby the relays R1 and R3 of the automatic operation circuit are again energized. Energization of the relays R1 and R3 serves to transfer the textile fabric in either the forward or backward direction. Now assuming that the forward drive counter ACF has been set to the number 60 and the loop length correction is effected when the count number of the counter ACF reaches the number 50, since the textile fabric is conveyed by use of the manual operation circuit after the loop length correction, no count is effected by the counter ACF and therefore the counter ACF starts to count from the number 51 after the apparatus is switched to the automatic operation circuit and the apparatus is switched to the reverse directional drive when the number 60 is reached by the counter ACF. The number of nips of the textile fabric is thus kept uniform. Thereafter the textile fabric is again transferred in the forward and backward directions by turns under the control of the control circuit shown in FIGS. 4A and 4B. If, during the forward travel of the textile fabric, the leading detectable portion 41 of the leader cloth 40 reaches the detector 47′ located at the position 47*b*, the relay R11 is energized, since the "*b*" contact T3*b* of the timer T3 has been turned on and the "*a*" contact MF*a*8 of the forward drive magnet switch MF has also been turned on at that time, whereby the relay R13 is energized and is self-retained.

Now it is recalled that the second loop length is longer than the prescribed loop length. In such a case, therefore, the trailing detectable portion 41′ of the leader cloth reaches the detector 47′ located at the position 47*b* before the leading detectable portion 41 of the leader cloth 40 reaches the detector 47 located at the position 47*c*. Since the "*a*" contact R13*a*1 of the relay R13 has been turned on and the "*b*" contact R13*b* of the relay R13 has been turned off at that time, the relay R12 is energized and is self-retained by the closing of the "*a*" contact R12*a*1 of the relay R12. Simultaneously the "*b*" contact R12*b* of the relay R12 is turned off and the self-retention of the relay R13 is released. In such a case, the motor 8 and thus the squeeze roll assembly 7 is kept enabled to travel without being stopped.

When the leading detectable portion 41 of the leader cloth 40 reaches the detector 47 located at the position 47*c*, the relay R14 is energized. Energization of the relay R14 causes the "*a*" contact R14*a*3 to be turned on. Since at that time the "*a*" contact R12*a*2 of the relay R12 has been turned on, a longer loop length detecting relay R16 is energized, which causes the "*a*" contact R16*a*3 to be turned on and the relay R17 to be energized. Energization of the relay R17 causes the "*b*" contact R17*b*3 to be turned off, whereby the relay R1 for the automatic operation circuit is deenergized and the motor 8 and thus the squeeze roll assembly 7 are caused to stop the forward drive. In the same manner as described previously, the relay R2 for the manual operation circuit is energized and the relay R12 is deenergized due to turning off of the "*b*" contact R17*b*1 of the relay R17. Since the a contact R17*a*2 is turned on due to energization of the relay R17, the magnetic valves MV1 and MV of one side of the cylinder for lifting the squeeze roll assembly and the cylinder 61 for rotating the stoppers are energized, whereby the upper roll 7′ of the squeeze roll assembly 7 is lifted to be separated from the lower roll of 7″ and the stoppers 55 and 56 are rotated, with the result that the corresponding portion of the textile fabric is taken up away from the guide rolls 13 and 13′.

When the upper roll 7′ of the squeeze roll assembly 7 reaches the uppermost position and the stoppers 55 and 56 are rotated to reach the uppermost position, the relay R18 is energized. Since the "*a*" contact R18*a*3 of the relay 18 is closed while the "*a*" contact R16*a*4 of the relay R16 and the "*a*" contact R2*a*4 of the relay R2 have been turned on, the magnet switch MR and the clutch relay CL2 for reverse drive are energized. However, since the upper roll 7′ of the squeeze roll assembly 7 has been separated from the lower roll 7′ of the squeeze roll assembly 7 at that time, the textile fabric continues to be transferred by means of the guide roll 13, i.e. the textile fabric continues to be transferred in the backward direction. During the backward travel of the textile fabric, the trailing detectable portion 41′ of the leader cloth 40 reaches the detector 47′ located at the position 47*b*, when the relay R11 is energized, since the "*b*" contact R13*b* of the relay R13 has been turned on and the "*a*" contact MR*a*7 of the magnet switch MR and the "*a*" contact R16*a*1 of the relay R16 have been turned on at that time.

Energization of the relay R11 causes the "*a*" contact R11*a*2 be turned on and thus causes the relay R19 to be energized, whereby the "*b*" contact R19*b*2 of the relay R19 is turned off and the magnet switch MR and the clutch relay CL2 are deenergized, whereby the lower roll 7′ of the squeeze roll assembly 7 and the guide roll 13 are caused to stop the backward drive. Thus, the textile fabric is cause to stop the backward transfer. Thus, correction of the second loop length is completed.

Thereafter, in the same manner as described previously, the relay R21 for returning the squeeze roll assembly 7 and the stoppers 55 and 56 is energized, whereby the upper roll 7′ of the squeeze roll assembly 7 and the stoppers 55 and 56 are returned to their original positions. When the upper roll 7′ of the squeeze roll assembly 7 and the stoppers 55 and 56 have been returned to the original positions, the timer T4 and the relay *mf* are energized. The carriage 50 is moved to the following loop length position through energization of the relay *mf*. When the carriage 50 reaches the prescribed position, the relay R20 is energized to stop the carriage 50.

Energization of the timer T4 causes R22 to be energized, whereby the relays R1 and R3 for the automatic operation circuit are again energized, with the result that the textile fabric is transferred in either the forward or backward direction.

Thereafter, correction of the individual loop lengths is carried out sequentially in the same manner. If and when correction of all the individual loop lengths is completed and the carriage 50 reaches the final loop length position, the limit switch LS3′ provided at that position is turned on and the limit switch LS3 provided in a ganged fashion with the limit switch LS3′ is turned off, whereby the relay *mf* is deenergized, with the result that the carriage 50 is stopped. Since the "*a*" contact R19*a*2 of the relay R19 has been turned on when the limit switch LS3' is turned on, a timer T5 for completion of correction of all the individual loop lengths is energized and self-retained due to the closing of the "*a*" contact T5*a*, while the "*b*" contact T5*b* of the timer T5 is turned off after the lapse of the predetermined delay time period preset thereby, whereby the relay R10 is deenergized. Deenergization of the relay R10 causes the "*a*" contact R10*a* to be turned off, whereby the loop length correcting circuit is brought in a disabled state.

The FIG. 11 control circuit is also shown comprising a push button PB*b* for deenergizing the relay R10, a push button PB*d* for deenergizing the timer T5, and a push button PB*c* for reverse driving the motor 64 for driving the carriage 50. Depression of the push button PB*c* causes the backward drive relay *mr* to be energized, whereby the motor 64 is driven in the backward direction and the carridge 50 is moved in the direction opposite to the former. When the carriage 50 returns to its original position, the limit switch LS4 provided at the position is turned off, whereby the motor 64 is caused to stop the reverse drive, i.e. the carriage 50 is stopped.

Loop Length Correcting Mode (2)

In the foregoing, an embodiment of the loop length correcting mode was described in which two detectable portions were provided in the textile fabric to be processed and were spaced apart from each other by a distance commensurate with the prescribed reference loop length. Alternatively, only a single detectable portion may be employed in the textile fabric, while the control circuit for loop length correction is modified.

Figure 12:
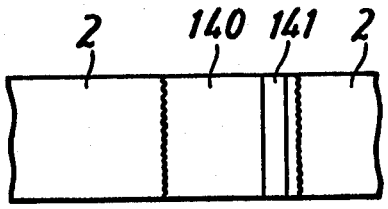
FIG. 12 schematically shows a second embodiment of a loop length correcting cloth which comprises a single detectable portion.

FIG. 12 schematically shows another embodiment of a loop length correcting cloth or a leader cloth 140, which comprises a single detectable portion 141. The loop length correcting operation by use of the leader cloth 140 shown in FIG. 12 is carried out in a manner similar to that of the FIG. 5 embodiment which comprises two detectable portions 41 and 41'. However, according to the embodiment of the leader cloth 140 of FIG. 12, rotation of the lower roll 7'' of the squeeze roll assembly 7 is detected by the use of sensors provided in operative association with the said single detectable portion 141 and the detected outputs are counted by the use of addition/subtraction or reversible counters, whereby the individual loop lengths are measured in terms of the number of rotations of the lower roll 7'' of the squeeze roll assembly 7.

Figure 13:
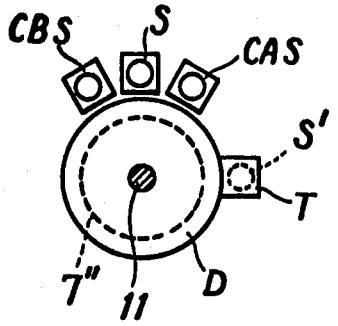
FIG. 13 is similar to FIG. 3 but shows a sensor assembly for detecting the rotation of the shaft of the squeeze roll assembly, which can be advantageously employed in the second embodiment.

FIG. 13 is similar to FIG. 3 but shows a sensor assembly for detecting the rotation of the shaft of the squeeze roll assembly, which can be advantageously employed in the embodiment now in discussion. Referring to FIG. 13, the shaft 11 of the lower roll 7'' of the squeeze roll assembly 7 is concentrically provided with a disk D having a projection T to which an object to be detected S' is mounted. Further, sensors S, CBS and CAS, such as proximity switches, are provided along the path of rotation of the said object S' for detecting the object S', so that the said object S' is detected by these sensors S, CBS and CAS each time the squeeze roll assembly 7 makes one complete revolution. The sensor S shown in FIG. 13 corresponds to the sensor S shown in FIG. 3 and is connected to the above described counters CA and CB. On the other hand, the sensors CAS and CBS are connected to loop length measuring counters CA and CB, respectively, as to be more fully described hereinafter.

According to the embodiment now in discussion, in correcting the first loop length, the above described counter CA is enabled if and when the detectable portion 141 passes the detector 47' (see FIG. 6) during the forward travel of the textile fabric 2, whereupon the detected output from the sensor CAS is counted by the counter CA until the detectable portion 141 reaches the detector 47, whereby the travelling amount of the textile fabric 2 between these detectors 47' and 47 is measured in terms of the number of rotations of the lower roll 7'' of the squeeze roll assembly 7, which represents the product of the circumference of the lower roll 7'' and the number of counts by the counter CA.

More specifically, if and when the detectable portion 141 is detected by means of the detector 47 during the forward travel of the textile fabric 2, the motor 8 is stopped. At that time, the counter CA has counted the number of rotations of the squeeze roll assembly 7 which occured while the textile fabric 2 was being conveyed from the detector 47' to the detector 47. The count number represents the amount of travel of the textile fabric 2 from the position of the detector 47' to the position of the detector 47. Once the motor 8 is stopped, similarly to the former embodiment, the squeeze roller assembly 7 is placed in an inactive state or the upper roll 7' of the squeeze roll assembly is raised, while the corresponding portion of the textile fabric is maintained at rest by means of the stoppers 55 and 56.

Now let it be assumed, for example, that the prescribed loop length is 35m and the number of rotations of the squeeze roll assembly 7 required for the textile fabric 2 to travel the said prescribed loop length of 35m from the position of the detector 47' to the position of the detector 47 is the number of 20. The motor 8 is then started in such a manner that the said corresponding portion is maintained at rest. If the first loop length is shorter than the prescribed loop length, the counter CA counts to a number smaller than the preset count number of 20, say the number of 15, when the detectable portion reaches the detector 47. In such a case, therefore, the textile fabric is caused to further travel for an amount of time corresponding to the difference between the preset count number and the measured count number, i.e. the number of five ($20 - 15 = 5$), and the motor 8 is stopped if and when the count number by the counter CA reaches the preset count number of 20. Correction of the first loop length is thus completed. After completion of the first loop length correction, the stoppers 55 and 56 and the squeeze roll assembly 7 are returned to the original state and the detectors 47 and 47' and the stoppers 55 and 56 are moved to the positions corresponding to the next adjacent loop length.

If the first loop length is longer than the prescribed loop length, the number of counts by the counter CA when the detectable portion 141 reaches the sensor 47 must have become a number such as 25. However, according to the embodiment in discussion, the counter CA has been structured such that the maximum count number is set to 20 and the "count up" output from the counter CA is applied to the counter CB to enable the same, whereby thereafter the detected output from the sensor CBS is counted by means of the counter CB. Since it is assumed that the actual loop length is longer than the prescribed loop length, the difference between the prescribed count number and the measured count number, e.g. the number of minus five ($20 - 25 = -5$)

must have been counted by means of the counter CB. The textile fabric 2 is then caused to travel backward in accordance with the count number in the counter CB, while the counting operation is effected in the counter CB in the minus direction this time. When the count number in the counter CB becomes zero, the motor now rotating in the reverse direction is stopped. Thereafter, the subsequent individual loop lengths are corrected in the same manner in turn.

Figure 14A:
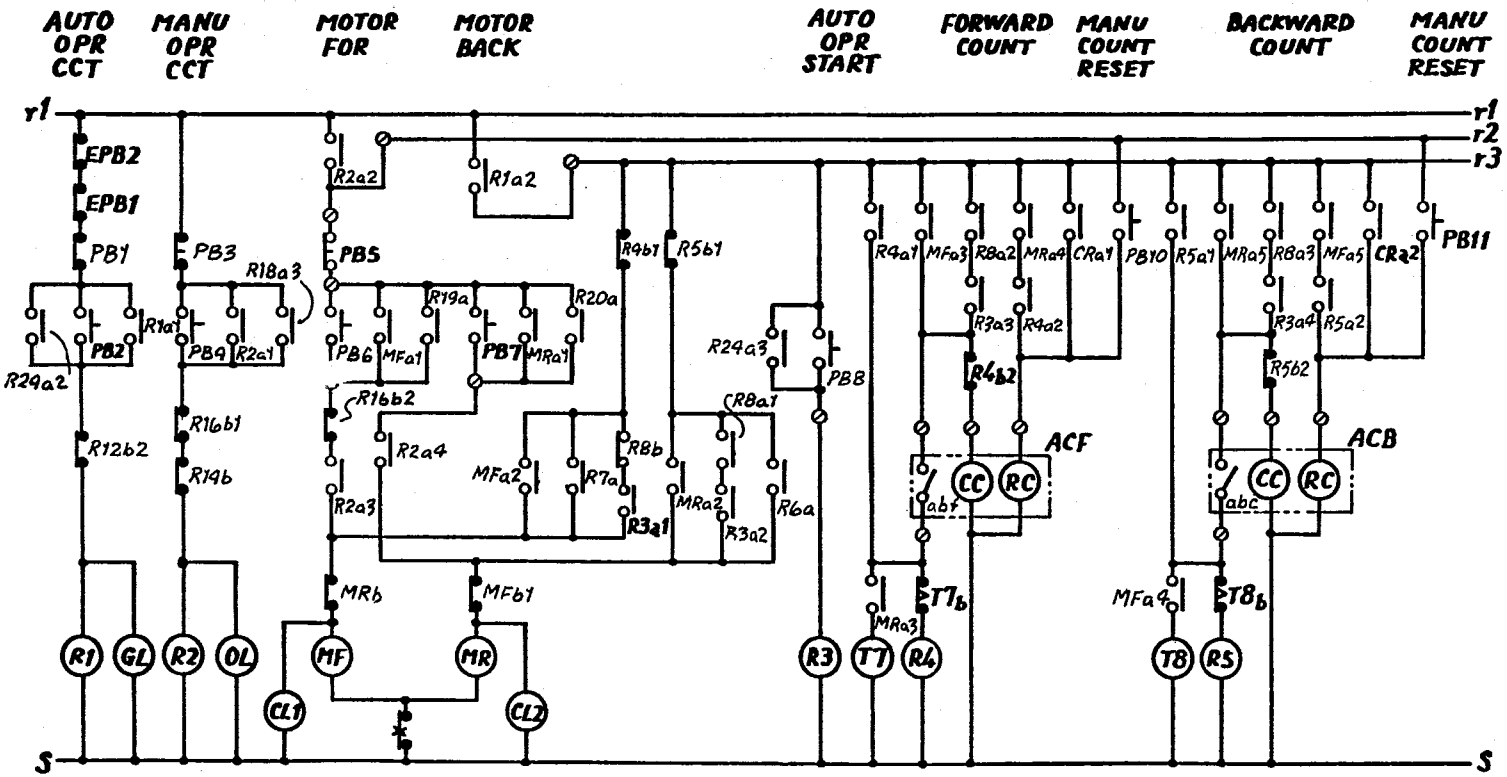
FIG. 14A is similar to FIG. 4A but shows a schematic diagram of a control circuit for a normal processing operation to be employed in the second embodiment, FIG. 4B being employed to be combined with FIG. 14A for control of the normal processing of the second embodiment.
Figure 14B:
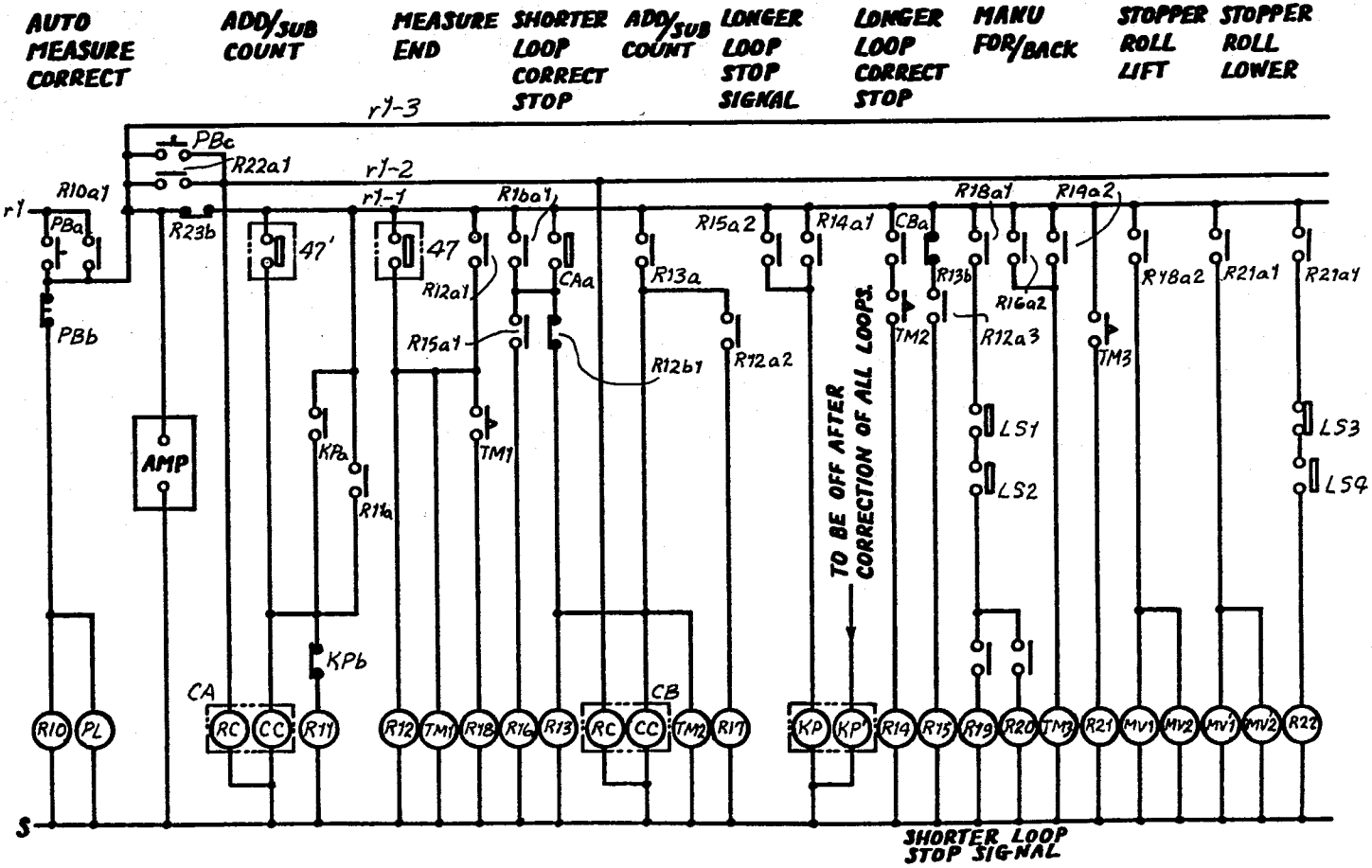
FIGS. 14B and 14C are similar to FIG. 11 but show a schematic diagram of a control circuit of the loop length correction of the second embodiment.
Figure 14C:
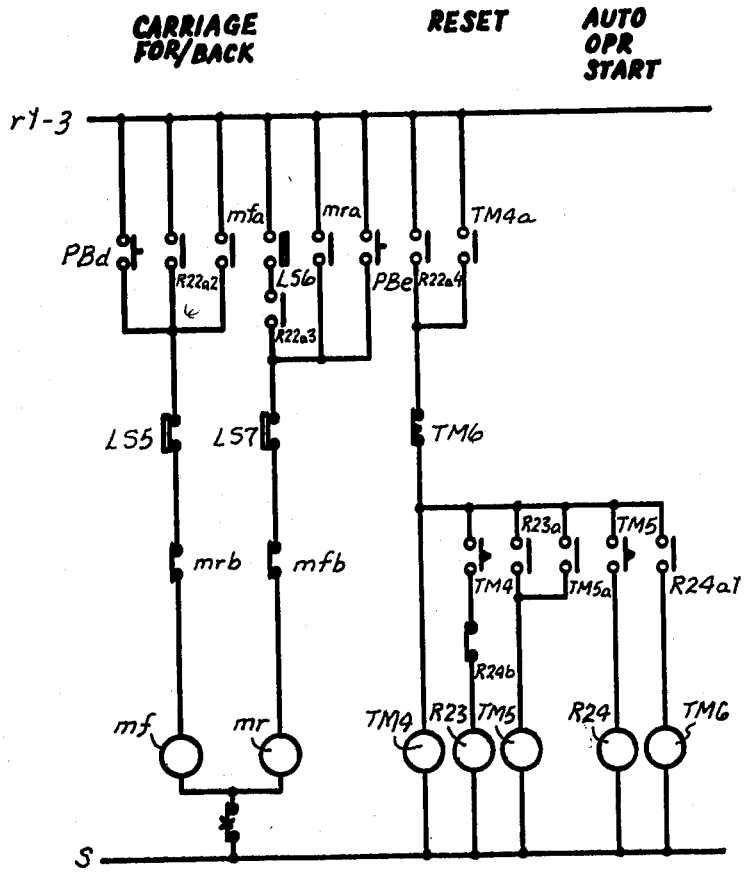

FIG. 14A is similar to FIG. 4A but shows a schematic diagram of a control circuit for a normal processing operation to be employed in the embodiment now in discussion, FIG. 4B being employed to be combined with FIG. 14A for control of the normal processing of the embodiment now in discussion. In comparison of the FIG. 14A diagram with the FIG. 4A diagram, only a minor portion of the FIG. 4A diagram has been modified. Such modification will be touched on subsequently in conjunction with the description of the loop length correction of the embodiment now in discussion. On the other hand, FIGS. 14B and 14C are similar to FIG. 11 but show a schematic diagram of a control circuit of the loop length correction of the embodiment now in discussion. It is pointed out that since the FIGS. 14B and 14C diagram show another embodiment of the control different from the FIG. 11 embodiment, like reference characters have been used in FIGS. 14B and 14C to designate different portions, as compared with the FIG. 11 embodiment.

Now referring to FIGS. 14B and 14C and, if necessary, also to FIG. 14A, the loop length correction of the embodiment in discussion will be described. To that end, let it be assumed, that the prescribed loop length is 35m, which corresponds to the number of 20 in terms of the number of counts by means of the counters CA and CB, as described previously. Further let it be assumed that the individual loop lengths of the textile fabric remaining in the processing chamber are 25m, 45m, 25m, 25m, 45m, 25m, and 25m, respectively, in the order beginning at the introduction side of the processing chamber 1. When it is desired to correct the individual loop lengths of the textile fabric, the leader cloth 140 is connected between the trailing end of the textile fabric remaining in the processing chamber 1 at the introduction side of the processing chamber 1 and the leading end of the textile fabric to be processed subsequently. On the other hand, the detectors 47 and 47' are brought to the positions **47*b* and 47*a* and the stoppers 55 and 56 are brought to the positions 55*a* and 56*a*, as shown in FIG. 6, by way of an initial condition. On the assumption of the above described initial condition for the loop length correcting operation, the operation of the loop length correcting circuit shown in FIGS. 14A, 14B and 14C will be described as follows. The FIGS. 14B and 14C circuit comprises various switches, contacts and relays connected between buses *r*1-3, *r*1-2 and *r*1-3** and S in the manner shown. For the purpose of initiation of loop length correcting mode, a push button PB*a* of an automatic loop length correcting circuit in FIG. 14B is depressed, whereby a relay R10 is energized and the "*a*" contact **R10*a* is turned on, thereby to self-retain the relay R10. As a result an amplifier AMP for the detectors 47 and 47' is energized and thus the detectors 47 and 47'** are placed in an operable or active state.

The textile fabric 2 is transferred forwardly and backwardly by turns while it is processed in the processing chamber, as described previously by way of the normal processing mode. During the forward travel of the textile fabric 2, the detectable portion 141 of the leader cloth 140 comes to pass the detector 47', whereby the detector 47' is closed in response to the detectable portion 141. As a result, the counter CA is enabled to perform a counting operation. Simultaneously, the relay R11 is energized and is self-retained due to turning on of the "*a*" contact **R11*a***.

Since it was assumed that the first loop length is shorter than the prescribed loop length, the detectable portion 141 reaches the second sensor 47 before the count number in the counter CA reaches the preset number of 20, and the sensor 47 is closed, which causes a relay R11 to be energized. Since the relay R12 is energized, the "*a*" contacts **R12*a*1, R12*a*2 and R13*a*** are turned on, while the "*b*" contacts **R12*b*1, R12*b*2 and R12*b*3 are turned off. The relay R12** is self-retained due to turning on of the "*a*" contact **R12*a*1. Since a relay R13** has been deenergized and the "*b*" contact **R13*b*** has been turned on when the "*a*" contact **R12*a*3 is turned on, a relay R15** is turned on, which causes the "*a*" contact **R15*a*2** to be turned on, whereby a keep relay KP is energized. Energization of the keep relay KP causes the "*a*" contact KP*a* to be turned on, which serves to self-retain the counter CA. On the other hand, the "*b*" contact KP*b* of the keep relay KP is turned off, whereby a relay R11 is deenergized. Turning off of the "*b*" contact **R12*b*2 causes a relay R1 (see FIG. 14A**) to be deenergized and turning off of the "*b*" contact **R12*b*3 causes the forward drive magnet switch MP (see FIG. 14A) to be deenergized, whereby the motor 8 is caused to stop the forward drive and accordingly the textile fabric 2 is caused to stop the forward travel. Simultaneously with energization of the relay R12, the timer TM1** is energized and the "*a*" contact TM1 of the timer TM1 is closed after the lapse of a predetermined delay time period, when the relay R18 is energized. Energization of the relay R18 causes the "*a*" contact **R18*a*2 to be turned on, whereby the stopper lifting magnetic valve MV1 and the upper roll lifting magnetic valve MV2 are turned on. As a result, the stoppers 55 and 56 and the upper roll 7' of the squeeze roll assembly 7 are lifted. Energization of the relay R18** causes the "*a*" contact **R18*a*3 (see FIG. 14A) to be turned on, whereby the relay R2 of the manual operation circuit (see FIG. 14A**) be energized, which is self-retained due to turning on of the "*a*" contact **R2*a*1. Energization of the relay R2** also causes the "*a*" contact **R2*a*2** to be turned on.

If and when the stoppers 55 and 56 and the upper roll 7' of the squeeze roll assembly 7 reach the uppermost positions, the respective limit switches LS1 and LS2 are responsively closed. At that time, the "*a*" contact **R18*a*1 of the above described relay R18 has been turned on. Similarly, the relay R15** has been energized and hence the "*a*" contact **R15*a*3 has been turned on. Therefore, the relay R19** for manual forward drive is energized.

Energization of the relay R19 causes the "*a*" contact **R19*a* (see FIG. 14A) to be turned on. At that time, the relay R2** has been energized and the "*a*" contacts **R2*a*2 and R2*a*3 (see FIG. 14A) have been turned on. The relay R16** has been deenergized and the "*b*" contact **R16*b*2 has been turned on. Therefore, the magnet switch MF and the clutch relay CL1 for motor forward drive are energized, whereby the motor 8 is driven in the forward direction. Since at that time the upper roll 7' of the squeeze roll assembly 7** has been raised, as described previously, to be separated from the lower roll 7", the textile fabric 2 is caused to travel in the forward direction by means of the guide roll 13', while only the corresponding portion of the textile fabric 2 taken up by the stoppers 55 and 56 is maintained at rest. If and when the count number by the counter CA reaches the present number of 20 during the forward travel of the textile fabric 2, the "a" contact CAa is turned on. At that time the relay R15 has been energized and hence the "a" contact R15a1 has been turned on. Therefore, the relay R16 for shorter loop length stoppage is energized. Energization of the relay R16 causes the "a" contacts R16a1 and R16a2 to be turned on and causes the "b" contacts R16b1 and R16b2 to be turned off. The relay $R_{16}$ is thus self-retained due to turning on of the "a" contact R16a1. Turning off of the "b" contact R16b1 makes the relay R2 to be deenergized, whereby the "a" contacts R2a2 and R2a3 are turned off. At that time the "b" contact R16b2 of the relay R16 has been turned off. As a result the magnet switch MF and the clutch relay CL1 for the motor forward drive are deenergized, whereby the motor 8 is caused to stop the forward drive and thus the txtile fabric is caused to stop the forward travel. Thus, correction of the first loop length is completed.

Turning on of the "a" contact R16a2, as described above, causes the timer TM3 to be energized. Energization of the timer TM3 causes the "a" contact TM3 be turned on after the lapse of a predetermined delay time period, whereby the relay R21 is energized. Energization of the relay R21 causes the a contact R21a1 to be turned on, whereby the magnetic valve MV1' for lowering the stoppers and the magnetic valve MV2' for lowering the upper roll 7' are energized. As a result the stoppers 55 and 56 and the upper roll 7' of the squeeze roll assembly 7 are lowered to return to the original positions.

When the stoppers 55 and 56 and the upper roll 7' of the squeeze roll assembly 7 reach the lowermost positions i.e. the original positions, the respective limit switches LS3 and LS4 are responsively turned on. Since at that time the relay R21 has been energized and the "a" contact R21a2 has been turned on, the relay R22 is energized. Energization of the relay R22 causes the "a" contacts R22a1 and R22a2 to be turned on. Turning on of the "a[contacts R22a1 causes the reset coil RC to be energized, whereby the counter CA is reset. On the other hand, since the "a" contact R22a2 is turned on, the magnet switch mf for forward driving the carriage 50 is energized and is self-retained due to turning on of the "a" contact mfa. As a result, the carriage 50 is caused to move in the forward direction. At that time, turning off of the "b" contact mfb ensures that energization of the magnet switch mr for reverse driving the carriage 50 is prevented. If and when the carriage 50 reaches the next adjacent position, the limit switch LS5 is responsively turned off, whereby the magnet switch mf for forward driving the carriage 50 is deenergized, with the result that the carriage 50 is stopped. The above described energization of the relay R22 also causes the "a" contact R22a4 to be turned on. As a result, the timer TM4 is energized and is self-retained due to closing of the "a" contact TM4a. After the lapse of a predetermined delay time period since the timer TM4 is energized, the contact TM4 is turned on and the relay R23 is energized. Since the relay R23 is energized, the "b" contact R23b is turned off, which causes the correction circuit connected to the bus r1-1 to be disabled or deenergized. Since the "a" contact R23 of the relay R23 is turned on at the same time, the timer TM5 is energized and is self-retained due to the closing of the "a" contact TM5a. After the lapse of a predetermined delay time period since the timer TM5 is energized, the contact TM5 is turned on, which causes the relay R24 to be energized.

Energization of the relay R24 causes the "b" contact R24b to be turned off. As a result, the relay R23 is deenergized and the "b" contact R23b is turned on. Therefore, the correction circuit connected to the bus r1-1 is again enabled or energized. Since the relay R24 is energized, the "a" contact R24a2 (see FIG. 14A) is turned on. Since the relay R12 has been deenergized when the "b" contact R23b of the relay R23 has been turned off and hence the correction circuit has been deenergized, the "b" contact R12b2 has been turned on. Therefore, the relay R1 is energized and the "a" contact R1a2 is turned on. Since the relay R24 is energized, as described previously, the "a" contact R24a3 (see FIG. 14A) is also turned on. As a result the relay R3 is energized and the "a" contact R3a1 is turned on. Since the "a" contacts R1a2 contacts R1a2 and R3a1 are turned on, as described above, the magnet switch MF for motor forward drive is energized. As a result, the motor 8 is caused to be driven in the forward direction and hence the textile fabric 2 is caused to travel in the forward direction. Since the relay R24 is energized, as described above, the "a" contact R24a1 is also turned on. Therefore, the timer TM6 is energized. After the lapse of a predetermined delay time period, the contact TM6 of the timer TM6 is turned off. As a result, the relay R24 and the timers TM4, TM5 and TM6 are turned off.

When the magnet switch MF is energized and the motor 8 is driven in the forward direction, as described above, the above described relay 23 is deenergized and the "b" contact R23b is turned on, while the keep relay KP is energized and the "a" contact KPa is turned on. Therefore, the counter CA is caused to start the counting operation simultaneously with the forward drive of the motor 8.

Now it is recalled that it was assumed that the second loop length is longer than the prescribed loop length. Therefore, the count number in the counter CA reaches the preset number of 20 before the detectable portion 141 reaches the second sensor 47 located at the position 47c. When the count number in the counter CA reaches the predetermined number of 20, the "a" contact CAa is responsively turned on. As a result the relay R13 is energized and is self-retained due to closing of the "a" contact R13a. Simultaneously then "b" contact R13b is turned off. At that time, the other counter CB is brought to an enabled condition for the counting operation. Even after the counter CA reaches the predetermined count number of 20, the motor 8 and thus the squeeze roll assembly 7 continues the forward drive without being stopped. Simultaneously with energization of the relay R13, the timer TM2 is also energized and after the lapse of a predetermined delay time period the contact TM2 is turned on.

If and when the detectable portion 141 reaches the second detector 47 located at the position 47c, the relay R12 is energized and is self-retained because of closing of the "a" contact R12a1. The "a" contact R12a2 is also closed simultaneously. Since the "a" contact R13a of the relay R13 has been turned on at that time, the relay R13 for stopping the longer loop length is energized. Energization of the relay R12 causes the "b" contacts R12*b*2 and R12*b*3 to be turned off. Turning off the "*b*" contact R12*b*2 causes the relay R1 to be deenergized. Turning off of the "*b*" contact R12*b*3 causes the magnet switch MF for motor forward drive to be deenergized, whereby the motor 8 is caused to stop the forward drive. Simultaneously with energization of the relay R12, the timer TM1 is energized and after the lapse of a predetermined delay time period the contact TM1 is turned on, whereby the relay R18 is energized. It is pointed out that when the detectable portion 141 reaches the second detector 47 located at the position 47*c*, the counter CB has reached the count number corresponding to the length difference of the second loop length minus the prescribed loop length.

Since the relay R17 is energized as described previously, the "*a*" contact R17*a* is turned on. Since the relay R18 is energized as described previously, the "*a*" contacts R18*a*1, R18*a*2 and R18*a*3 (see FIG. 14A) are turned on. Turning on the "*a*" contact R18*a*2 causes the magnetic valves MV1 and MV2 to be energized, whereby the stoppers 55 and 56 and the upper roll 7′ of the squeeze roll assembly 7 are raised in the same manner as described previously. Turning on the "*a*" contact R18*a*3 (see FIG. 14A) causes the relay R2 to be energized. The relay R2 is self-retained because of closing of the "*a*" contact R2*a*1. Another "*a*" contact R2*a*2 of the relay R2 is also turned on simultaneously.

If and when the stoppers 55 and 56 and the upper roll 7′ of the squeeze roll assembly 7 reach the uppermost positions, the respective switches LS1 and LS2 are responsively closed. At that time the relay R18 has been energized and hence the "*a*" contact R18*a*1 thereof has been closed, while the relay R17 has also been energized and the "*a*" contact R17*a* thereof has been turned on. Therefore, the reverse drive relay R20 is energized. Energization of the relay R20 causes the "*a*" contact R20*a* (see FIG. 14A) to be turned on. At that time the relay R2 has been energized and hence the "*a*" contacts R2*a*2 and R2*a*4 (see FIG. 14A) have been turned on. Therefore, the magnet switch MR and the clutch relay CL2 for the motor reverse drive are energized. As a result the motor 8 is driven in the reverse direction. Since at that time the upper roll 7′ of the squeeze roll assembly 7 has been raised and separated from the lower roll 7″, the textile fabric 2 is caused to travel in the backward direction by means of the guide roll 13, while the corresponding portion of the textile fabric 2 as raised by the stoppers 55 and 56 is maintained at rest. As the textile fabric 2 is transferred in the backward direction, the counter CB makes subtraction or reverse count.

If and when the above described counter CB reaches the count number of zero during the backward travel of the textile fabric 2, responsively the "*a*" contact CB*a* of the counter CB is turned on. Since at that time the contact TM2 of the timer TM2 has been turned on, the relay R14 is energized. Energization of the relay R14 causes the "*b*" contact R14*b* (see FIG. 14A) to be turned off, which causes the relay R2 to be deenergized. As a result the "*a*" contacts R2*a*2 and R2*a*4 thereof are turned off and accordingly the magnet switch MR and the clutch relay CL2 for the reverse drive are deenergized. As a result, the motor 8 is caused to stop the reverse drive and the textile fabric 2 is accordingly caused to stop the backward travel. Correction of the second loop length is thus completed. The above mentioned energization of the relay R14 also causes the "*a*" contact R14*a*2 to be turned on, whereby the timer TM3 is energized and after the lapse of a predetermined delay time period the contact TM3 is turned on. As a result the relay R21 is energized. Energization of the relay R21 causes the a contact R21*a*1 to be turned on. As "*a*" result, the magnetic valves MV1′ and MV2′ are energized and the stoppers 55 and 56 and the upper roll 7′ of the squeeze roll assembly 7 are lowered.

When the stoppers 55 and 56 and the upper roll 7′ of the squeeze roll assembly 7 reach the lowermost positions i.e. the original positions, the respective limit switches LS3 and LS4 are responsively turned on. Since at that time the relay R21 has been energized and the "*a*" contact R21*a*2 has been turned on, the relay R22 is energized. Energization of the relay R22 causes the "*a*" contacts R22*a*1 and R22*a*2 to be turned on. Turning on the "*a*" contacts R22*a*1 causes the reset coil RC to be energized, whereby the counter CA is reset. On the other hand, since the "*a*" contact R22*a*2 is turned on, the magnet switch *mf* for forward driving the carriage 50 is energized and is self-retained due to turning on of the "*a*" contact *mfa*. As a result, the carriage 50 is caused to move in the forward direction. At that time, turning off the "*b*" contact *mfb* ensures that energization of the magnet switch *mr* for reverse driving the carriage 50 is prevented. If and when the carriage 50 reaches the next adjacent position, the limit switch LS5 is responsively turned off, whereby the magnet switch *mf* for forward driving the carriage 50 is deenergized, with the result that the carriage 50 is stopped. The above described energization of the relay R22 also causes the "*a*" contact R22*a*4 to be turned on. As a result, the timer TM4 is energized and is self-retained due to closing of the "*a*" contact TM4*a*. After the lapse of a predetermined delay timer period since the timer TM4 is energized, the contact TM4 is turned on and the relay R23 is energized. Since the relay R23 is energized, the "*b*" contact R23*b* is turned off, which causes the correction circuit connected to the bus *r*1-1 be disabled or deenergized. Since the "*a*" contact R23 of the relay R23 is turned on at the same time, the timer TM5 is energized and is self-retained due to the closing of the "*a*" contact TM5*a*. After the lapse of a predetermined delay time period since the timer TM5 is energized, the contact TM5 is turned on, which causes the relay R24 to be energized.

Energization of the relay R24 causes the "*b*" contact R24*b* to be turned off. As a result, the relay R23 is deenergized and the "*b*" contact R23*b* is turned on. Therefore, the correction circuit connected to the bus *r*1-1 is again enabled or energized. Since the relay R24 is energized, the "*a*" contact R24*a*2 (see FIG. 14A) is turned on. Since the relay R12 has been deenergized when the "*b*" contact R23*b* of the relay R23 has been turned off, and hence the correction circuit has been deenergized, the "*b*" contact R12*b*2 has been turned on. Therefore, the relay R1 is energized and the "*a*" contact R1*a*2 is turned on. Since the relay R24 is energized, as described previously, the "*a*" contact R24*a*3 (see FIG. 14A) is also turned on. As a result, the relay R3 is energized and the "*a*" contact R3*a*1 is turned on. Since the "*a*" contacts R1*a*2 and R3*a*1 are turned on, as described above, the magnet switch MF for motor forward drive is energized. As a result, the motor 8 is caused to be driven in the forward direction and hence the textile fabric 2 is caused to travel in the forward direction. Since the relay R24 is energized, as described above, the "*a*" contact R24*a*1 is also turned on. Therefore, the timer TM6 is energized. After the lapse of a predetermined delay time period, the contact TM6 of the timer TM6 is turned off. As a result, the relay R24 and the timers TM4, TM5 and TM6 are turned off.

When the magnet switch MF is energized and the motor 8 is driven in the forward direction, as described above, the above described relay 23 is deenergized and the "*b*" contact R23*b* is turned on, while the keep relay Kp is energized and the "*a*" contact KP*a* is turned on. Therefore, the counter CA is caused to start the counting operation simultaneously with the forward drive of the motor 8.

Thereafter the above described operation is repeated for the subsequent individual loop lengths of the textile fabric 2. The FIGS. 14B and 14C control circuit is shown comprising a push button PB*b* for deenergizing the loop length correcting circuit, a push button PB*c* for manual resetting, a push button PB*d* for manual forward drive of the carriage 50, a push button PB*e* for reverse drive of the carriage 50, a limit switch LS6 for detecting the final position of the carriage 50, a limit switch LS7 for detecting the initial position of the carriage 50, and a magnet switch *mr* for reverse driving the carriage 50.

Other Embodiments

In the foregoing, the second embodiment of the loop length correction was described in which the reversible counters CA and CB are utilized for the purpose of measuring the amount of travel of the textile fabric 2. However, this should not be construed by way of limitation. Alternatively, timers may be employed for the purpose of measuring the amount of travel of the textile fabric, assuming that the apparatus is structured such that the textile fabric is transferred in a fixed speed.

The above described embodiments were described as employing two detectors 47 and 47'. Additionally, however, another detector may be provided forward of the detector 47 to be used for stopping the textile fabric upon detection, whereby the preceding loop length forward of the loop length presenting being corrected can be measured in advance by the use of the same. This enables prediction of excesses and shortages of the loop length before correction, and accordingly enables control of the remaining amount of the textile fabric in the reserver. As a result, the loop length to be corrected merely has a slight difference with respect to the prescribed loop length. Therefore, the apparatus may be structured such that if the loop length to be corrected is of an error small enough not to cause entanglement of the textile fabric, the corresponding loop length may be allowed to be transferred without correction of the loop length thereof.

Figure 15:
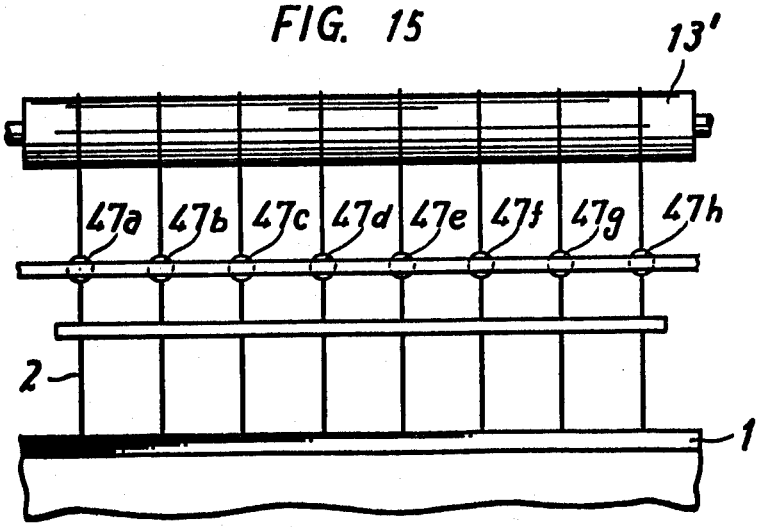
FIG. 15 shows a plan view of a detector assembly provided associated with the individual loop lengths of the textile fabric set around the guide roll.

Both of the foregoing two embodiments of the loop length correction were described as employing the carriage 50 including the detectors 47 and 47' and the stoppers 55 and 56 adapted to be moved in the axial direction of the squeeze roll assembly 7. However, this again should not be construed by way of limitation. An alternative embodiment in this connection is shown in FIG. 15. FIG. 15 shows a plan view of a detector assembly provided in association with the individual loop lengths of the textile fabric 2 set around the guide roll 13'. As seen in FIG. 15, the detector assembly comprises eight detectors 47*a* through 47*h* spaced equally so as to be individually associated with the nip portions of the textile fabric 2. The stoppers 55 and 56 (not shown in FIG. 15) are provided movably in the same manner as described in the foregoing embodiments. Alternatively, eight stoppers may be fixedly provided while only a pair of detectors 47 and 47' is provided movably, contrary to the foregoing embodiment. Alternatively, a detector assembly comprising eight detectors and a stopper assembly comprising eight stoppers may be fixedly provided such that each is associated with the individual loop length portion. In employing the fixedly provided detector assembly and/or stopper assembly, a selection control circuit is provided for selectively enabling a pair of adjacent two detectors and/or a pair of adjacent two stoppers in turn in place of selective positioning of the detectors 47 and 47' and the stoppers 55 and 56 in turn to the individual loop length positions as described in the foregoing two embodiments.

By way of a modification to the stoppers of such a fork type as described in the foregoing embodiments, a stopper assembly of a grip type may be employed for the purpose of separating the textile fabric 2 from the guide rolls 13 and 13'. Altenatively, such a grip type stopper assembly may be provided along the transfer path of the textile fabric, for example between the squeeze roll assembly 7 and the guide rolls 13 and 13', such that the textile fabric 2 is gripped, with the result that the textile fabric can be stopped without separating the same from the guide rolls 13 and 13'.

Figure 16:
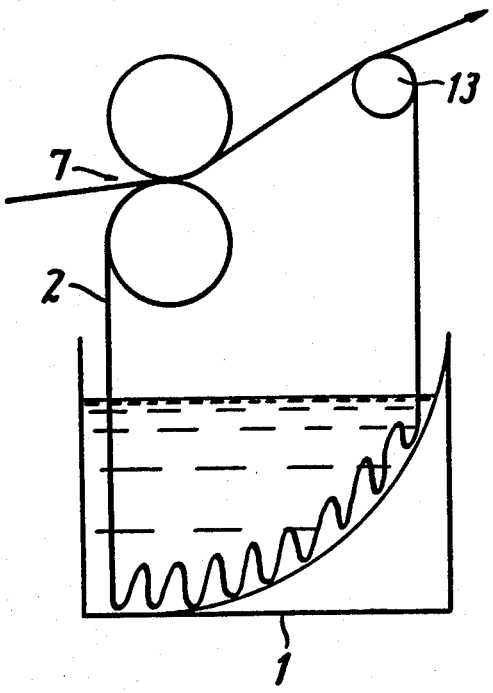
FIG. 16 shows schematically a side view of a modification of the processing apparatus for use in practicing the present invention, wherein only one side guide roll is provided.
Figure 17:
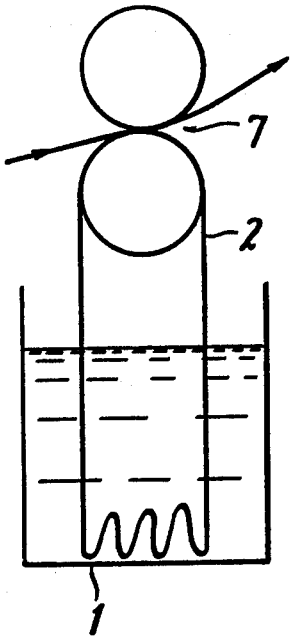
FIG. 17 schematically shows a side view of a modification of the processing apparatus for use in practicing the present invention, wherein no guide rolls are provided.

FIG. 16 shows schematically a side view of a modification of the processing apparatus for use in practicing the present invention, wherein only one side guide roll 13 is provided. Similarly, FIG. 17 schematically shows a side view of a modification of the processing apparatus for use in practicing the present invention, wherein no guide rolls are provided. These modified processing apparatuses are structured such that the textile fabric is transferred only in one direction.

With particular reference to FIG. 1, it is recalled that the storage chambers 3 and 3' are provided adjacent to the introduction and delivery sides of the processing chamber 1 for the purpose of tentative storage of a predetermined but varying amount of textile fabric 2 in each thereof, so that the feed of the textile fabric 2 in and out of the inventive apparatus is buffered. Preferably such a predetermined amount of the textile fabric 2 in each of the storage chambers 3 and 3' is selected to be substantially the same as the travel amount of the textile fabric for one forward feeding operation of the reciprocating forward and backward feeding operations. In this connection it is readily appreciated that, as a result of the correction of the individual loop lengths of the textile fabric 2 in the processing chamber 1, the remaining amounts in both the storage chamber 3 and 3' could become extremely imbalanced. Therefore, it is desired that, before the following normal processing is initiated, the textile fabric be transferred for the purpose of equalizing the remaining amounts in both of the storage chambers 3 and 3'. Such equalizing transfer can be achieved by the skillful use of an additional reversible counter to be provided in the abovedescribed embodiment. Such equalizing operation will be described in the following. For the purpose of the equalizing operation an additional reversible counter for counting the number of rotations of the squeeze roll assembly 7 is provided such that the same is enabled upon detection of the leading detectable portion 41 of the leader cloth 40 by means of the detector 47 and is disabled upon detection of the trailing detectable portion 41' of the leader cloth 40 by means of the detector 47'. First let it be assumed that the loop length presently being corrected is shorter than the prescribed reference loop length.

Therefore, the leading detectable portion 41 is first detected by the detector 47, whereby the said additional counter is enabled, and during further forward feeding operation, the trailing detectable portion 41' is then detected by means of the detector 47', whereupon the said additional counter is disabled. As a result, the said additional counter counts, in the plus direction, the number of rotations of the squeeze roll assembly 7 corresponding to the difference length between the loop length presently being corrected and the prescribed reference loop length, say the number of plus 5. Further, let it be assumed that the following loop length in correction this time is longer than the prescribed reference loop length. In that case, the trailing detectable portion 41' is first detected by the detector 47' and thereafter the leading detectable portion is detected by the detector 47 during the forward feeding operation. Upon detection of the leading detectable portion 41 by the detector 47, the said additional counter is enabled. The textile fabric 2 is then conveyed in a backward direction, as described previously. The said additional counter is disabled upon detection of the trailing detectable portion 41' by the detector 47' during the backward feeding operation. Hence, the said additional counter causes the counting operation to be conducted in the minus direction. Correction of all the individual loop lengths is completed in this way, while the said additional counter makes reversible counting of the squeeze roll assembly with respect to the difference length between the individual loop lengths and the prescribed reference loop length in an accumulative manner. As a result, the count number in the said additional counter, after completion of correction of all the individual loop lengths, indicates the amount of shift of the textile fabric 2 in the inventive apparatus after correction of all the individual loop lengths. Therefore, before the following normal processing operation is initiated, the apparatus is driven to feed the textile fabric 2 in the inventive apparatus so as to make the count number in the said additional counter to zero, whereby the remaining amounts in both storage chambers 3 and 3' are equalized. It is pointed out that such an equalizing feeding operation is carried out, while the upper roll 7' of the squeeze roll assembly 7 is raised, until the count number in the additional counter becomes zero. It is further pointed out that if the count number is of the plus sign the equalizing feeding operation is effected in the backward direction, whereas if the count number is of the minus sign the equalizing feeding operation is effected in the forward direction. However, while the equalizing feeding operation is effected, feed rolls 17 and 17' and the delivery rolls 18 and 18' are also driven.

It would further be possible for those skilled in the art to make many changes and modifications of the present invention without departing from the spirit and scope of the present invention. Therefore, it is intended that the true scope of the present invention is limited only by the appended claims.

What is claimed is:

1. A method for unifying the individual loop lengths of a continuous textile fabric fed along a path in a feeding direction through a textile fabric processing apparatus, said method comprising the step of:

providing a textile fabric processing apparatus having a squeeze roller assembly elongated in an axial direction, passing said textile fabric successively and spirally around said squeeze roller assembly from one end to the other end thereof so as to cause squeezing and nipping of said fabric at a plurality of nip points, to form a plurality of loop-like portions of said fabric formed between adjacent ones of said plurality of nip points, providing said fabric with at least one detectable portion thereof, providing a plurality of detectors disposed along said path at respective ones of said plurality of nip points for detecting said at least one detectable portion, stopping the feed of said fabric at each respective nip point when said detector disposed at said each respective nip point detects one of said at least one detectable portion of said fabric, determining a point on that portion of said fabric backward adjacent with respect to said feeding direction, which point is spaced from said each respective nip point by a predetermined reference loop length, correct feeding that portion of said fabric backward adjacent with respect to said feeding direction until said point determined by said determining step reaches a nip point backward adjacent to said each respective nip point, whereby the loop length of one of said loop-like portion is corrected to said reference loop length, releasing said stoppage of that portion of said fabric backward adjacent with respect to said feeding direction, and repeating said steps above with respect to other loop-like portions.

2. A method for unifying the individual loop lengths of the textile fabric in accordance with claim 1, wherein said passing step comprises the steps of process feeding said continuous textile fabric in a first direction and process feeding said continuous textile fabric in a second direction wherein the amount of travel of said continuous textile fabric in said first direction of the process feeding operation is set to be larger than that in said second direction of the process feeding operation, so that said continuous textile fabric is advanced in said first direction by a predetermined amount of travel as a result of a predetermined number of said first and second directions of reciprocating process feeding operations.

3. A method for unifying the individual loop lengths of the textile fabric in accordance with claim 1, wherein said stopping step comprises the step of separating a portion of said continuous textile fabric in the vicinity of said each respective nip point.

4. A method for unifying the individual loop lengths of the textile fabric in accordance with claim 3, wherein said releasing step comprises the step of returning said portion of said continuous textile fabric to an original position thereof.

5. A method for unifying the individual loop lengths of the textile fabric in accordance with claim 1, wherein said stopping step comprises the step of gripping a portion of said continuous textile fabric in the vicinity of said each respective nip point.

6. A method for unifying the individual loop lengths of the textile fabric in accordance with claim 5, wherein said releasing step comprises the step of returning said portion of said continuous textile fabric to an original position thereof.

7. A method for unifying the individual loop lengths of the textile fabric in accordance with claim 1, wherein said providing step comprises the step of positioning said each detector in the vicinity of said each respective nip point.

8. A method for unifying the individual loop lengths of the textile fabric in accordance with claim 1, wherein said stopping step comprises the step of selectively enabling said detector associated with said each respective nip point.

9. A method for unifying the individual loop lengths of the textile fabric in accordance with claim 1, wherein said stopping step comprises the step of providing a stopping device in the vicinity of said each respective nip point.

10. A method for unifying the individual loop lengths of the textile fabric in accordance with claim 9, wherein said stopping step comprises the step of selectively enabling said stopping device provided in the vicinity of said each respective nip point.

11. A method for unifying the individual loop lengths of a continuous textile fabric fed in a feeding direction through a textile fabric processing apparatus, said method comprising the step of:

providing a textile fabric processing apparatus having a squeeze roller assembly elongated in an axial direction, passing said textile fabric successively and spirally around said squeeze roller assembly from one end to the other end thereof so as to cause squeezing and nipping of said fabric at a plurality of nip points, to form a plurality of loop-like portions of said fabric formed between adjacent ones of said plurality of nip points, providing said fabric with at least one detectable portion thereof, providing a plurality of detectors disposed along said path at respective ones of said plurality of nip points for detecting said at least one detectable portion, stopping the feed of said fabric at each respective nip point when said detector disposed at said each respective nip point detects one of said at least one detectable portion of said fabric, determining a point on that portion of said fabric backward adjacent with respect to said feeding direction, which point is spaced from said each respective nip point by a predetermined reference loop length, correct feeding that portion of said fabric backward adjacent with respect to said feeding direction until said point determined by said determining step reaches a nip point backward adjacent to said each respective nip point, whereby the loop length of one of said loop-like portions is corrected to said reference loop length, releasing said stoppage of that portion of said fabric backward adjacent with respect to said feeding direction, and repeating said steps above with respect to other loop-like portions;

wherein said method comprises the additional step of:

measuring the amount of travel of said continuous textile fabric during said passing step;

said plurality of detectors each comprising a first detector and a second detector backward adjacent thereto;

said determining step comprising the steps of:

measuring said amount of travel upon detection of said detectable portion by means of said second detector, disabling the measuring upon detection of said detectable portion by means of said first detector, whereby actual loop length of the loop like portion between the nip point associated with said first detector and the nip point associated with said second detector is determined, and comparing said actually measured loop length of said loop like portion with said reference loop length for evaluating the difference length therebetween; said correct feeding step comprising the step of feeding said continuous textile fabric a distance corresponding to said difference length in a direction corresponding thereto.

12. A method for unifying the individual loop lengths of the textile fabric in accordance with claim 11, wherein said measuring operation comprises the step of counting the number of rotations of said squeeze roll means.

13. A method for unifying the individual loop lengths of the textile fabric in accordance with claim 11, wherein said measuring operation comprises the step of measuring the time period of said feeding step.

14. A method in accordance with claim 1, wherein said plurality of detectors each comprises first and second detectors, and wherein said continuous textile fabric further comprises an additional detectable portion spaced apart by a distance equal to said reference loop length from said first mentioned detectable portion, and said determining step comprises the step of detecting said additional detectable portion by means of said second detector backward adjacent to said first detector.

15. A method of loop length correcting a continuous spirally set textile fabric being conveyed through a processing tank in a forward feed direction, comprising the steps of:

(a) providing a pair of squeeze rollers having one end and another end adjacent to said processing tank for squeezing a fabric passing therethrough at a nip point;

(b) successively and spirally setting said textile fabric around said squeeze rollers from one end to the other end thereof so as to define a plurality of said nip points whereby a plurality of loop like portions are formed between respective adjacent two nip points of said continuous textile fabric, (c) providing said continuous textile fabric with at least one detectable portion in corresponding at least one of said loop like portions, (d) process feeding said continuous textile fabric for processing the same, (e) detecting said at least one detectable portion of said continuous textile fabric in the vicinity of a predetermined at least one nip point, (f) stopping, upon detection of said detectable portions of said continuous textile fabric, the feed of the loop like portion of said continuous textile fabric corresponding to said at least one nip point, (g) determining a point on said continuous textile fabric spaced by a predetermined reference loop length from said corresponding at least one nip point of said continuous textile fabric, (h) feeding said continuous textile fabric, except for said loop like portion corresponding to said at least one corresponding nip point of said continuous textile fabric which is stopped, until said determined point reaches the nip point adjacent to said corresponding nip point, whereby the loop length of said corresponding loop like portion is corrected to said reference loop length, (i) releasing said stoppage of said loop like portion stopped in step (f), and (j) repeating said steps (c) through (i) with respect to other loop like portions.

16. A method in accordance with claim 15, wherein said process feeding step comprises the steps of process feeding said continuous textile fabric in a first direction and process feeding said continuous textile fabric in a second direction, wherein the amount of travel of said continuous textile fabric in said first direction of the process feeding operation is set to be larger than that in said second direction of the process feeding operation, so that said continuous textile fabric is advanced in said first direction by a predetermined amount of travel as a result of a predetermined number of said first and second directions of reciprocating process feeding operations.

17. A method in accordance with claim 15, wherein said stopping step comprises the step of separating a portion of said continuous textile fabric in the vicinity of said predetermined at least one nip point of said continuous textile fabric.

18. A method in accordance with claim 17, wherein said releasing step comprises the step of returning said loop like portion of said continuous textile fabric to its original position prior to performance of step (f).

19. A method in accordance with claim 15, wherein said stopping step comprises the step of gripping said loop like portion of said continuous textile fabric in the vicinity of said predetermined at least one nip point.

20. A method in accordance with claim 19, wherein said releasing step comprises the step of returning said loop like portion of said continuous textile fabric to its original position prior to performance of step (f).

21. A method in accordance with claim 15, wherein said detecting step comprises the step of positioning a detector in the vicinity of said predetermined at least one nip point.

22. A method in accordance with claim 15, wherein said detecting step comprises the steps of positioning a plurality of detectors at corresponding predetermined nip points, and selectively enabling a given one of said detectors.

23. A method in accordance with claim 15, wherein said stopping step comprises the step of positioning a stopping device in the vicinity of each of said predetermined at least one nip point.

24. A method in accordance with claim 15, wherein said stopping step comprises the steps of positioning a plurality of stopping devices at corresponding predetermined nip points, and selectively enabling a given one of said stopping devices.

25. A method of loop length correcting a continuous spirally set textile fabric being conveyed through a processing tank in a forward feed direction, comprising the steps of:

(a) providing a pair of squeeze rollers having one end and another end adjacent to said processing tank for squeezing a fabric passing therethrough at a nip point;

(b) successively and spirally setting said textile fabric around said squeeze rollers from one end to the other end thereof so as to define a plurality of said nip points whereby a plurality of loop like portions are formed between respective adjacent two nip points of said continuous, textile fabric, (c) providing said continuous textile fabric with at least one detectable poortion in corresponding at least one of said loop like portions, (d) process feeding said continuous textile fabric for processing the same, (e) detecting said at least one detectable portion of said continuous textile fabric in the vicinity of a predetermined at least one nip point, (f) stopping, upon detection of said detectable portions of said continuous textile fabric, the feed of the loop like portion of said continuous textile fabric corresponding to said at least one nip portion, (g) determining a point on said continuous textile fabric spaced by a predetermined reference loop length from said corresponding at least one nip point of said continuous textile fabric, (h) feeding said continuous textile fabric, except for said loop like portion corresponding to said at least one corresponding nip point of said continuous textile fabric which is stopped, until said determined point reaches the nip point adjacent to said corresponding nip point, whereby the loop length of said corresponding loop like portion is corrected to said reference loop length, (i) releasing said stoppage of said loop like portion stopped in step (f), and (f) repeating said steps (c) through (i) with respect to other loop like portions;

said method comprising the additional step of:

measuring the amount of travel of said continuous textile fabric during said process feeding step;

said determining step comprising the steps of:

providing a first detector at a corresponding first nip point and a second detector at a corresponding second nip point, backward adjacent to said first nip point, measuring said amount of travel upon detection of said detectable portion by means of said second detector, disabling the measuring upon detection of said detectable portion by means of said first detector, whereby the actual loop length of the loop like portion between the nip point associated with said first detector and the nip point associated with said second detector means is determined, and comparing said actual loop length of said loop like portion with said reference loop length for evaluating the difference length therebetween;

said correct feeding step comprising the step of feeding said continuous textile fabric a distance equal to said difference length in a direction corresponding thereto.

26. A method for unifying the individual loop lengths of the textile fabric in accordance with claim 25, wherein said measuring operation comprises the step of counting the number of rotations of said squeeze rollers.

27. A method for unifying the individual loop lengths of the textile fabric in accordance with claim 25, wherein said measuring operation comprises the step of measuring the time duration of said feeding step.

28. A method for unifying the individual loop lengths of the textile fabric in accordance with claim 25, comprising the additional step of providing said continuous textile fabric with an additional detectable portion spaced apart by said reference loop length from said first mentioned detectable portion, and said determining step comprises the step of detecting said additional detectable portion by means of said second detector.

* * * * *

UNITED STATES PATENT AND TRADEMARK OFFICE

CERTIFICATE OF CORRECTION

PATENT NO. : 4,107,801

DATED : August 22, 1978

INVENTOR(S) : Yoshishige Tachibana

It is certified that error appears in the above-identified patent and that said Letters Patent are hereby corrected as shown below:

Column 4, line 30, before "direction" (second occurrence) insert --(--.
Column 4, line 31, after "tion" insert --)--.
*Column 7, line 15, "unevennes" should be --unevenness--.
*Column 9, line 9, "aseembly" should be --assembly--.
Column 9, line 65, "a" (first occurrence) should be --"a"--.
Column 10, line 22, "a" should be --"a"--.
Column 11, line 20, ""a"" should be --"a"--.
Column 11, line 54, "push buttons" should be --push button--.
Column 12, line 10, "31,31,...50" should be --30,31,...50--.
Column 14, line 20, "causes" should be --cause--.
Column 16, line 24, "pocessing" should be --processing--.
*Column 18, line 27, "ralay" should be --relay--.
Column 25, line 45, ""a[" should be --"a"--.
Column 29, line 8, "Kp" should be --KP--.
Column 36, line 4, "poortion" should be --portion--.
Column 36, line 27, "(f)" should be --(j)--.

Signed and Sealed this

*First* Day of *May 1979*

[SEAL]

*Attest:*

RUTH C. MASON
*Attesting Officer*

DONALD W. BANNER
*Commissioner of Patents and Trademarks*